US009862198B2

(12) United States Patent
Tsukahara

(10) Patent No.: US 9,862,198 B2
(45) Date of Patent: Jan. 9, 2018

(54) UNIT USED IN LIQUID JET RECORDING APPARATUS, AND LIQUID JET RECORDING APPARATUS

(71) Applicant: SEIKO EPSON CORPORATION, Tokyo (JP)

(72) Inventor: Katsutomo Tsukahara, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 14/740,541

(22) Filed: Jun. 16, 2015

(65) Prior Publication Data

US 2015/0360475 A1 Dec. 17, 2015

(30) Foreign Application Priority Data

Jun. 16, 2014 (JP) ..... 2014-123294

(51) Int. Cl.
*B41J 2/175* (2006.01)
*B41J 29/13* (2006.01)

(52) U.S. Cl.
CPC ..... *B41J 2/17523* (2013.01); *B41J 2/1752* (2013.01); *B41J 2/1753* (2013.01); *B41J 2/17513* (2013.01); *B41J 29/13* (2013.01)

(58) Field of Classification Search
CPC ..... B41J 2/17523; B41J 2/175; B41J 2/1752; B41J 2/17513
See application file for complete search history.

(56) References Cited

U.S. PATENT DOCUMENTS

| | | | | |
|---|---|---|---|---|
| 5,506,611 | A | 4/1996 | Ujita et al. | |
| 5,788,388 | A | 8/1998 | Cowger et al. | |
| 6,540,321 | B1 | 4/2003 | Hirano et al. | |
| 7,048,348 | B2 | 5/2006 | Mochizuki et al. | |
| 7,249,831 | B2 | 7/2007 | Childers et al. | |
| 7,452,062 | B2 | 11/2008 | Kimura et al. | |
| 7,845,776 | B2 | 12/2010 | Kachi | |
| 2002/0171713 | A1* | 11/2002 | Ueno | B41J 2/17509 347/49 |
| 2004/0046842 | A1* | 3/2004 | Rhee | B41J 2/17509 347/85 |

(Continued)

FOREIGN PATENT DOCUMENTS

| | | | |
|---|---|---|---|
| JP | 2014-172263 | A | 9/2014 |
| JP | 2014-237223 | A | 12/2014 |
| WO | 97/42035 | A1 | 11/1997 |

*Primary Examiner* — Jason Uhlenhake
(74) *Attorney, Agent, or Firm* — Global IP Counselors, LLP

(57) ABSTRACT

A unit that is used in a liquid jet recording apparatus and is used for connection of a liquid container, the liquid container including: a liquid container part that is capable of storing a liquid; and a liquid supply part that is in communication with an inside of the liquid container part and is capable of supplying the liquid to an liquid jet part of the liquid jet recording apparatus, the unit including: a medium positioning part that is capable of positioning a recording medium to which the liquid is ejected by the liquid jet part; and a flow channel connection part that is connectable to the liquid supply part and supplies the liquid from the liquid supply part to the liquid jet part, wherein the unit is configured to be attachable to and detachable from a main body of the liquid jet recording apparatus, the main body being provided with the liquid jet part.

19 Claims, 16 Drawing Sheets

FIRST STATE

(56) References Cited

U.S. PATENT DOCUMENTS

| | | | | |
|---|---|---|---|---|
| 2005/0219281 | A1* | 10/2005 | Seino | B41J 2/17523 347/6 |
| 2013/0257959 | A1* | 10/2013 | Itogawa | B41J 11/0015 347/16 |
| 2014/0026416 | A1* | 1/2014 | Shirono | B41J 2/17523 29/890.1 |
| 2014/0253645 | A1 | 9/2014 | Tsukahara et al. | |
| 2014/0360596 | A1 | 12/2014 | Tsukahara et al. | |
| 2015/0138283 | A1* | 5/2015 | Kanaya | B41J 2/175 347/85 |

* cited by examiner

FIRST STATE

SECOND STATE

PARTIAL CROSS-SECTIONAL VIEW ALONG F9A-F9A

PARTIAL CROSS-SECTIONAL
VIEW ALONG F9B-F9B

VIEW IN THE DIRECTION OF ARROW F15

UNIT USED IN LIQUID JET RECORDING APPARATUS, AND LIQUID JET RECORDING APPARATUS

BACKGROUND

1. Technical Field

The present invention relates to a technology for a unit used in a liquid jet recording apparatus, and a liquid jet recording apparatus.

2. Related Art

A technology in which one ink bag is attached to a side face of a printer housing is known (e.g., WO 97/42035). According to the technology disclosed in WO 97/42035, the ink in the ink bag is supplied to a cartridge attached to the inside of the printer, via a supply tube.

According to the technology disclosed in WO 97/42035, when attaching a ink bag to a printer, an ink supply part of the ink bag needs to be connected to the tip of the supply tube, which is unfixed and in a free state, and the ink bag needs to be housed in a casing fixed to the printer housing. Therefore, the operability at the time of attaching the ink bag to the printer can be degraded in some cases. Also, according to the technology disclosed in WO 97/42035, the casing in which the ink bag is housed is fixed to the side face of the printer when seen from the front face. Since the casing has a shape projecting in the horizontal direction (outward from the printer), the printer as a whole can be large in the horizontal direction in some cases.

Such problems are not limited to the technology used in a printer, but are common to technologies used in a liquid jet recording apparatus that ejects a liquid to a recording medium.

SUMMARY

The invention is made to solve at least some of the above-described problems, and aims to provide at least one of the following technologies. The first aim is to provide a technology for easily attaching/detaching a liquid container to/from a liquid jet recording apparatus. The second aim of the invention is to provide a technology for suppressing the increase in size of a liquid jet recording apparatus. In the related arts, there also are the demands for cost reduction, resource saving, manufacture simplification, improvement in usability, the technology for simplifying the configuration, and so on.

The invention is made to solve at least some of the above-described problems, and may be implemented in the following modes:

(1) One mode of the invention provides a unit that is used in a liquid jet recording apparatus and is used for connection of a liquid container. The liquid container includes: a liquid container part that is capable of storing a liquid; and a liquid supply part that is in communication with an inside of the liquid container part and is capable of supplying the liquid to a liquid jet part of the liquid jet recording apparatus. This unit includes a medium positioning part that is capable of positioning a recording medium to which the liquid is ejected by the liquid jet part; and a flow channel connection part that is connectable to the liquid supply part and supplies the liquid from the liquid supply part to the liquid jet part. Also, the unit is configured to be attachable to and detachable from a main body of the liquid jet recording apparatus, the main body being provided with the liquid jet part.

The unit in this mode includes the flow channel connection part to which the liquid supply part is connected, and accordingly the liquid container can be easily attached to and detached from the liquid jet recording apparatus by connecting or removing the liquid supply part to or from the flow channel connection part provided in the unit. In other words, the operability of the liquid container with respect to the liquid jet recording apparatus is improved. Also, since the unit in this mode includes the medium positioning part that is capable of positioning the recording medium and the unit is configured to be attachable to and detachable from the main body, the operability of the unit is improved compared to the case where the flow channel connection part and the medium positioning part are separately attached to or detached from the main body.

(2) The unit in the above-described mode may be located below the main body of the liquid jet recording apparatus, provided with the liquid jet part, in a top-to-bottom direction, and the medium positioning part may include a recording medium container part for storing the recording medium.

According to the unit in this mode, the unit is located below the main body in the top-to-bottom direction, and accordingly the increase in size of the liquid jet recording apparatus in the horizontal direction is suppressed. Also, the recording medium container part can store the recording medium.

(3) In the unit in the above-described mode, the flow channel connection part and the recording medium container part may be arranged next to each other in a horizontal direction.

According to the unit in this mode, it is possible to arrange the flow channel connection part and the recording medium container part while suppressing the increase in size of the unit in the top-to-bottom direction.

(4) The unit in the above-described mode may be located on a side face of the main body provided with the liquid jet part of the liquid jet recording apparatus, and the flow channel connection part and the medium positioning part may be arranged next to each other in a top-to-bottom direction.

According to the unit in this mode, the flow channel connection part and the medium positioning part can be arranged by effectively using the space in the top-to-bottom direction, and therefore it is possible to suppress the increase in size in the horizontal direction of the unit located on the side face.

(5) In the unit in the above-described mode, the medium positioning part may include a two-sided paper feed part that turns over the recording medium from one side to the other side.

According to the unit in this mode, recording can be easily performed on both sides of the recording medium.

The constituent elements included in the above-described modes of the invention are not all essential, and in order to solve some or all of the above-described problems or achieve some or all of the advantageous effects described in this specification, some of the constituent elements can be modified, omitted, and replaced with other constituent elements as necessary, and the limiting content can be partially omitted. Also, in order to solve some or all of the above-described problems or achieve some or all of the above-described advantageous effects, some or all of the technical features in any of the above-described modes of the invention can be combined with some or all of the technical features included in another one of the above-described modes of the invention so as to obtain an independent mode of the invention.

For example, one mode of the invention can be implemented as an apparatus that includes at least one element out of a plurality of elements, namely the medium positioning part and the flow channel connection part. In other words, this apparatus may have or not have the medium positioning part. Also, this apparatus may have or not have the flow channel connection part. According to such modes, it is possible to solve at least one of various problems such as achieving apparatus size reduction, cost reduction, resource saving, manufacture simplification, and improvement in usability. Some or all of the technical features of the above-described modes of the liquid container can be applied to this apparatus.

Note that the invention can be implemented in various modes, and can be implemented in various aspects such as a liquid jet recording apparatus including the unit and the liquid jet part that ejects the liquid, a method for manufacturing the unit, and a method for manufacturing the liquid jet recording apparatus.

BRIEF DESCRIPTION OF THE DRAWINGS

The invention will be described with reference to the accompanying drawings, wherein like numbers reference like elements.

DESCRIPTION OF EXEMPLARY EMBODIMENTS

Figure 1:
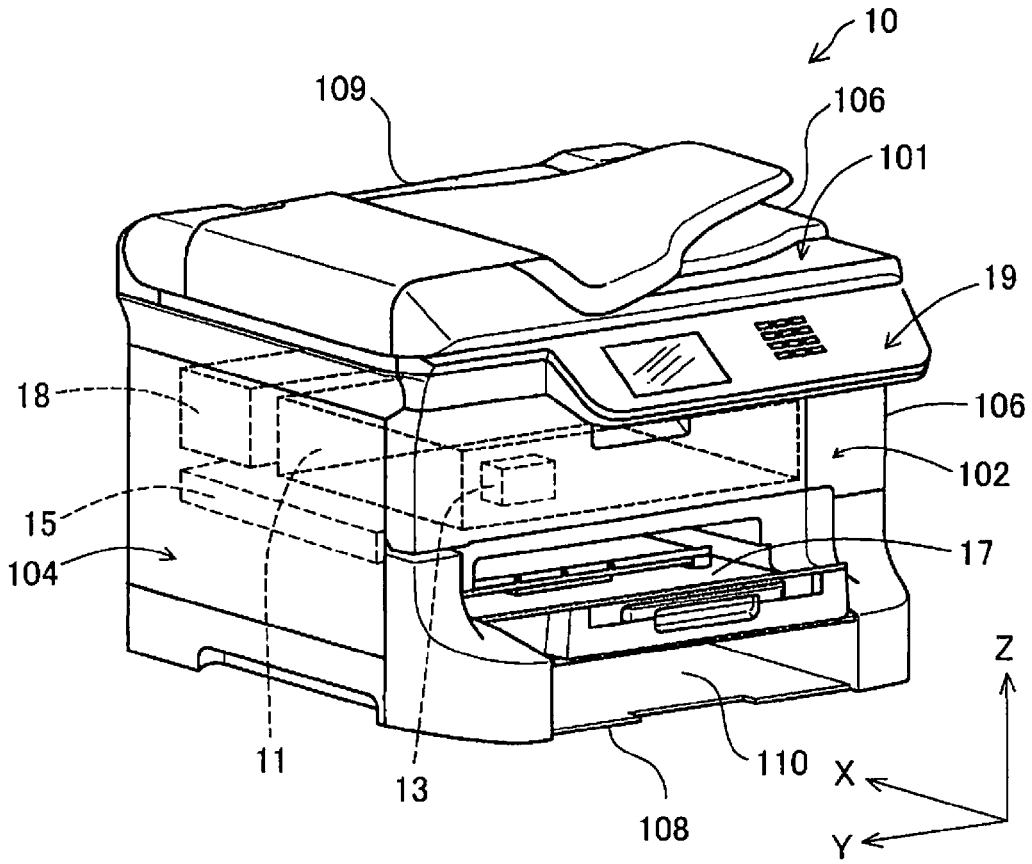
FIG. 1 is a first diagram illustrating a printer as a first embodiment.
Figure 2:
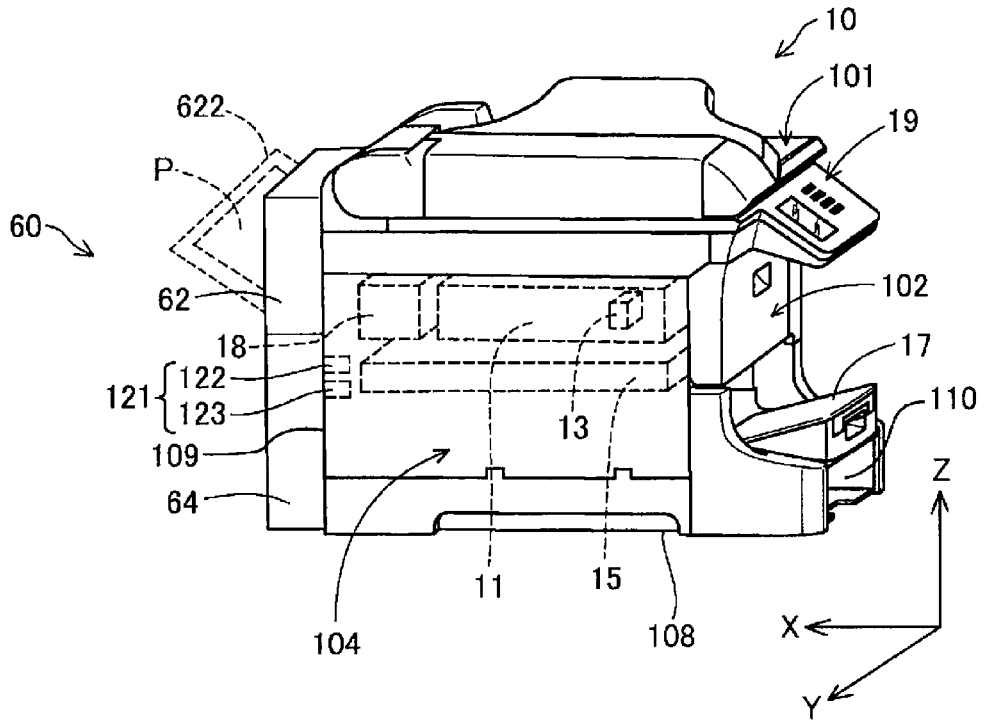
FIG. 2 is a second diagram illustrating a printer.
Figure 3:
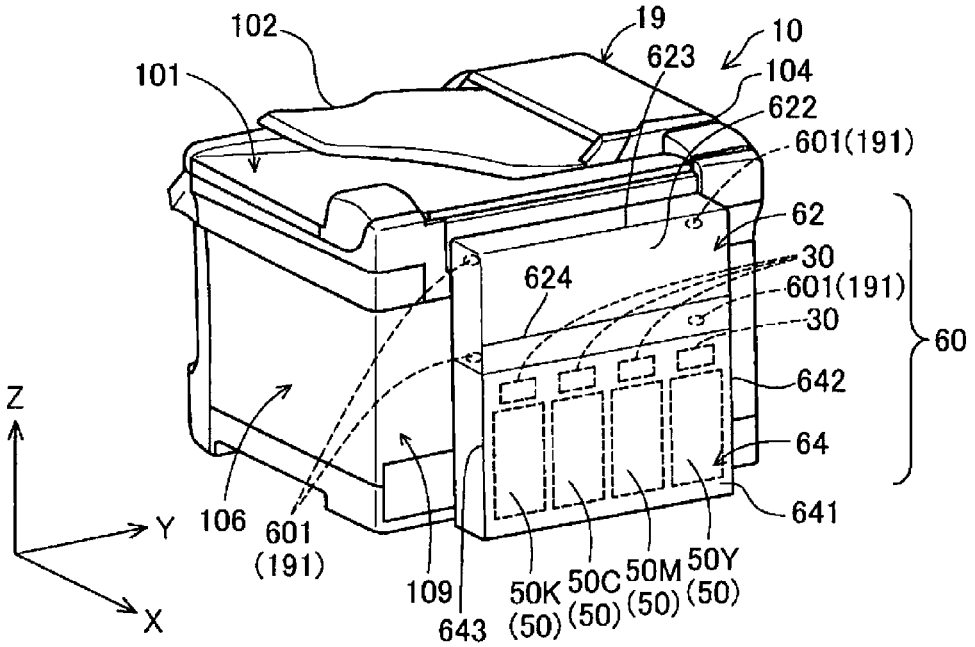
FIG. 3 is a third diagram illustrating a printer.
Figure 4:
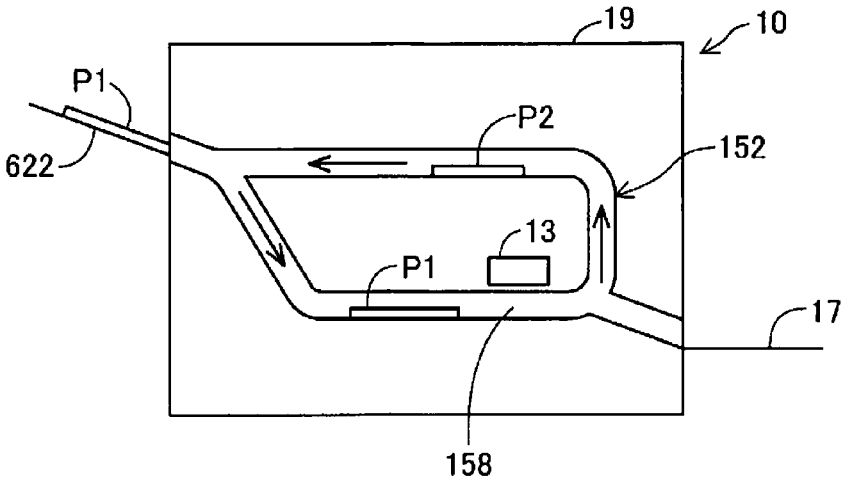
FIG. 4 is a diagram illustrating a conveyance mechanism.

A. First Embodiment:

A-1. Configuration of Liquid Jet Recording Apparatus 10:

FIG. 1 is a first diagram illustrating a printer 10 as a first embodiment of the invention. FIG. 2 is a second diagram illustrating the printer 10. FIG. 3 is a third diagram illustrating the printer 10. FIG. 4 is a diagram illustrating a conveyance mechanism 15. In FIG. 1 to FIG. 3, XYZ axes that are orthogonal to each other are depicted.

As shown in FIG. 1, the printer 10 as a liquid jet recording apparatus includes a main body 19 and, as a unit, a unit 60 for the recording apparatus (FIG. 2). The printer 10 is an inkjet printer. When the printer 10 is in the used state, the printer 10 is placed on the horizontal plane defined by the X axis direction and the Y axis direction. In other words, the Z axis direction coincides with the vertical direction (the top-to-bottom direction). The −Z axis direction coincides with the vertically downward direction, and the +Z axis direction coincides with the vertically upward direction. Ink as the liquid stored in a liquid container 50 (FIG. 3) is supplied to the printer 10, and the ink is ejected to a piece of printing paper P as a recording medium.

The main body 19 constitutes the printer body. As shown in FIG. 2, the main body 19 includes therein a recording mechanism 11, a conveyance mechanism 15, and a control part 18. The main body 19 substantially has the shape of a rectangular cuboid. As shown in FIG. 1 to FIG. 3, the main body 19 has a front face (first face, first wall) 102, a left side face (first side face, first side wall) 104, a right side face (second side face, second side wall) 106, a rear face (a second face, a second wall) 109, a top face (a third face, a third wall) 101, and a bottom face (a fourth face, a fourth wall) 108. The faces 101, 102, 104, 106, 108, and 109 constitute the outer envelope (housing) of the main body 19.

The front face 102 and the rear face 109 oppose each other. The left side face 104 and the right side face 106 oppose each other. The front face 102, the rear face 109, the left side face 104, and the right side face 106 are substantially perpendicular to the plane on which the printer 10 is placed. The top face 101 and the bottom face 108 oppose each other. The top face 101 and the bottom face 108 are substantially parallel with the plane on which the printer is placed. Each of the left side face 104 and the right side face 106 intersects with the front face 102 and the rear face 109. Here, the terms "substantially perpendicular" and "substantially parallel" includes the meanings of almost "perpendicular" and almost "parallel" in addition to the meaning of perfectly "perpendicular" and perfectly "parallel". In other words, the faces 101, 102, 104, 106, 108, and 109 are not perfectly flat and includes concavities and convexities, etc., and accordingly they may be almost "perpendicular" or almost "parallel" in terms of the appearance.

The X axis direction is the direction in which the front face 102 and the rear face 109 oppose each other. The Y axis direction is the direction in which the left side face 104 and the right side face 106 oppose each other. The Z axis direction is the direction in which the top face 101 and the bottom face 108 oppose each other. The X axis direction is the "depth direction" of the printer 10, the Y axis direction is the "width direction" of the printer 10, and the Z axis direction is the "height direction (top-to-bottom direction)" of the printer 10.

As shown in FIG. 2, the rear face 109 is provided with connection units 121 that is used for connection with the liquid containers 50. Four connection units 121 are provided (FIG. 2 shows only one of them) in correspondence with the number of the liquid containers 50. Each connection unit 121 includes a liquid connection part 122 and an electrical connection part (connector) 123. Ink from the liquid containers 50 is supplied to the liquid connection part 122. The liquid connection part 122 is connected to a tube (not shown in the drawings) for supplying ink to a recording head 13. The liquid connection part 122 has the shape of a needle, and is connected to a hose serving as a below-described flow passage member through which ink from the liquid container 50 is supplied. The electrical connection part 123 is electrically connected to a below-described circuit substrate included in the liquid container 50. The electrical connection part 123 is electrically connected to a control part 18 via an electrical wire.

The front face 102 is provided with a recording medium feeding part 110 that houses recording media, and a discharge tray 17 as a recording medium discharge part. The recording medium feeding part 110 houses a piece of printing paper P that are conveyed by the conveyance mechanism 15 to the recording head 13. The piece of printing paper P that has undergone the recording by the recording head 13 is discharged to the discharge tray 17. As shown in FIG. 3, main body-side attachment parts 191 for detachably attaching the unit 60 for the recording apparatus are provided on the rear face 109 of the main body 19. Four main body-side attachment parts 191 are provided. Each main body-side attachment parts 191 has a concave shape.

As shown in FIG. 1, the control part 18 controls the operation of the printer 10. For example, the control part 18 controls the operation of the recording mechanism 11, the operation of the conveyance mechanism 15, and the operation of a supply mechanism (not shown in the drawings) for sucking up the ink in the liquid containers 50.

The recording mechanism 11 has the recording head 13 as an liquid jet part that discharges (ejects) ink. The recording head 13 is in communication with the liquid containers 50. The recording head 13 performs recording (printing) of images or the likes by discharging ink onto the piece of printing paper P (FIG. 2) by using the ink supplied from the liquid containers 50. Also, the recording head 13 is configured to be movable in the Y axis direction (horizontal scanning direction), and performs recording while moving in the Y axis direction. This movement is achieved via a timing belt (not shown in the drawings) driven by a stepping motor (not shown in the drawings).

The conveyance mechanism 15 conveys the piece of printing paper P. For example, the conveyance mechanism 15 conveys the piece of printing paper P, which is located at a predetermined position such as in a paper feed tray 622 (FIG. 2), to the position where the recording head 13 can perform recording. Also, below the recording head 13, the conveyance mechanism 15 conveys the piece of printing paper P in the +X axis direction (vertical scanning direction), and conveys it to the discharge tray 17. Also, as shown in FIG. 4, the conveyance mechanism 15 has a turn-over mechanism 152 for performing recording on a front face P1 and a back face P2 of the piece of printing paper P. The turn-over mechanism 152 includes a conveyance passage 158 for guiding the piece of printing paper P, and a roller (not shown in the drawings) for conveying the piece of printing paper P. After the piece of printing paper P whose front face P1 has undergone recording by the recording head 13 is turned over, the piece of printing paper P, which has been turned over, is conveyed to the recording head 13.

As shown in FIG. 3, the unit 60 for the recording apparatus includes a recording medium positioning unit 62 as a medium positioning part, and a liquid supply apparatus 64. The unit 60 for the recording apparatus includes portions that are used for connection with the liquid containers 50 (attachment/detachment units 30 described below). The unit 60 for the recording apparatus is located on the rear face 109 as a face of the main body 19. The unit 60 for the recording apparatus is configured to be detachable from the main body 19. Specifically, the recording medium positioning unit 62 includes unit-side attachment parts 601 for detachably attaching to the main body 19. This unit-side attachment parts 601 engage with the main body-side attachment parts 191 provided on the rear face 109, and thus the unit 60 for the recording apparatus is attached to the rear face 109. Four unit-side attachment parts 601 are provided on the face of the recording medium positioning unit 62 that faces the rear face 109. The unit-side attachment parts 601 each have a convex shape so as to fit into the main body-side attachment parts 191 each having a concave shape. Note that the configurations of the unit-side attachment parts 601 and the main body-side attachment parts 191 are not limited to the above, and any configuration may be employed insofar as the unit 60 for the recording apparatus can be detachably attached to the main body 19. For example, in another embodiment, each of the unit-side attachment parts 601 may have a concave shape, and each of the main body-side attachment parts 191 may have a convex shape. Also, in another embodiment, the unit-side attachment parts 601 may be screws, and the main body-side attachment parts 191 may be members for receiving the screws, for example.

The recording medium positioning unit 62 and the liquid supply apparatus 64 are integrally formed. The recording medium positioning unit 62 and the liquid supply apparatus 64 are adjacent to each other. The recording medium positioning unit 62 and the liquid supply apparatus 64 including a flow channel connection part are arranged next to each other along the top-to-bottom direction. Specifically, the recording medium positioning unit 62 is located on the upper side, and the liquid supply apparatus 64 is located below the recording medium positioning unit 62. In another embodiment, the liquid supply apparatus 64 may be located on the upper side, and the recording medium positioning unit 62 may be located below the liquid supply apparatus 64.

When the printer 10 is seen from the side of the rear face 109 (from the +X axis direction) to which the unit 60 for the recording apparatus is attached, the unit 60 for the recording apparatus is located inside the substantially rectangular outer frame of the rear face 109. With respect to the top-to-bottom direction, the recording medium positioning unit 62 is located above the center of the rear face 109.

The recording medium positioning unit 62 is configured to position the piece of printing paper P on which recording is performed by the recording head 13 of the printer 10. The recording medium positioning unit 62 includes a paper feed tray 622 configured to be able to open and close. As shown in FIG. 3, the paper feed tray 622 is opened and closed as, of the recording medium positioning unit 62, an end portion 623 located in the vertically upward direction (+Z axis direction) is rotated about an end portion 624 as a pivot located in the vertically downward direction (−Z axis direction). The paper feed tray 622 shown in a dotted line in FIG. 2 is in its open state. The piece of printing paper P is placed on the paper feed tray 622 in the open state. When printing is started by the printer 10, the conveyance mechanism 15 conveys the piece of printing paper P on the paper feed tray 622 to the inside of the main body 19, and recording is performed by the recording head 13.

The paper feed tray 622 also serves as a two-sided paper feed part for turning over the piece of printing paper P from one side to the other side. Specifically, as shown in FIG. 4, after recording is performed by recording head 13 on the front face P1 of the piece of printing paper P that is placed on the paper feed tray 622 such that the front face P1 faces upward, the piece of printing paper P after being turned over by the turn-over mechanism 152 such that the back face P2 faces upward is placed on the paper feed tray 622. The piece of printing paper P placed on the paper feed tray 622 such that the back face P2 faces upward is conveyed to the discharge tray 17 after the back face P2 has undergone recording by the recording head 13. As described above, the paper feed tray 622 is also used for turning over the piece of printing paper P.

Although the recording medium positioning unit 62 above has a plate-like paper feed tray 622, it may have a housing-like recording medium container part (paper feed cassette) instead for housing printing sheets. The recording medium positioning unit 62 may also have the paper feed tray 622 and a paper feed cassette.

As shown in FIG. 3, the liquid supply apparatus 64 includes a casing 641, four liquid containers 50, and four attachment/detachment units 30. The casing 641 houses therein four liquid containers 50 and four attachment/detachment units 30. Here, when the four liquid containers 50 need to be distinguished from each other, signs "50K", "50C", "50M", and "50Y" are used. Note that the number of the liquid containers 50 and the number of the attachment/detachment units 30 are not limited to the above. For example, the number of the liquid containers 50 may be less than four, and may be five or more. Also, for example, the number of the attachment/detachment units 30 may be less than four, and may be five or more.

Each of the four liquid containers 50 contains (i.e., is filled with) a different kind of ink. In this embodiment, inks of the color black (K), yellow (Y), magenta (M), and cyan (C) are respectively stored in the different liquid containers 50. The liquid container 50K has a liquid container part storing the black ink. The liquid container 50C has a liquid container part storing the cyan ink. The liquid container 50M has a liquid container part storing the magenta ink. The liquid container 50Y has a liquid container part storing the yellow ink.

The four liquid containers 50 are arranged along the Y axis direction. The four attachment/detachment units 30 are arranged along the Y axis direction so as to correspond in arrangement position to the four liquid containers 50.

The attachment/detachment units 30 are for detachably attaching the liquid containers 50. The attachment/detachment units 30 are attached to, of the casing 641, the face on the side of the rear face 109. When the liquid container 50 is attached to the attachment/detachment unit 30, a supply mechanism (not shown in the drawing) of the printer 10, which has the function of a pump, sucks up the ink stored in the liquid container 50, thereby supplying the ink to the recording head 13 of the printer 10.

The casing 641 is configured to be openable and closable by rotating a second end portion 643, which is an end portion located in the −Y axis direction, about a first end portion 642 as a pivot, which is an end portion located in the +Y axis direction. The user can attach and detach the liquid containers 50 by opening the casing 641. Note that the casing 641 only needs to be openable and closable so that the liquid containers 50 can be attached and detached, and the configuration thereof is not limited to the above. For example, the casing 641 may be configured to be openable and closable by rotating the end portion of the casing 641 in the +Z axis direction about the end portion in the −Z axis direction.

Figure 5:
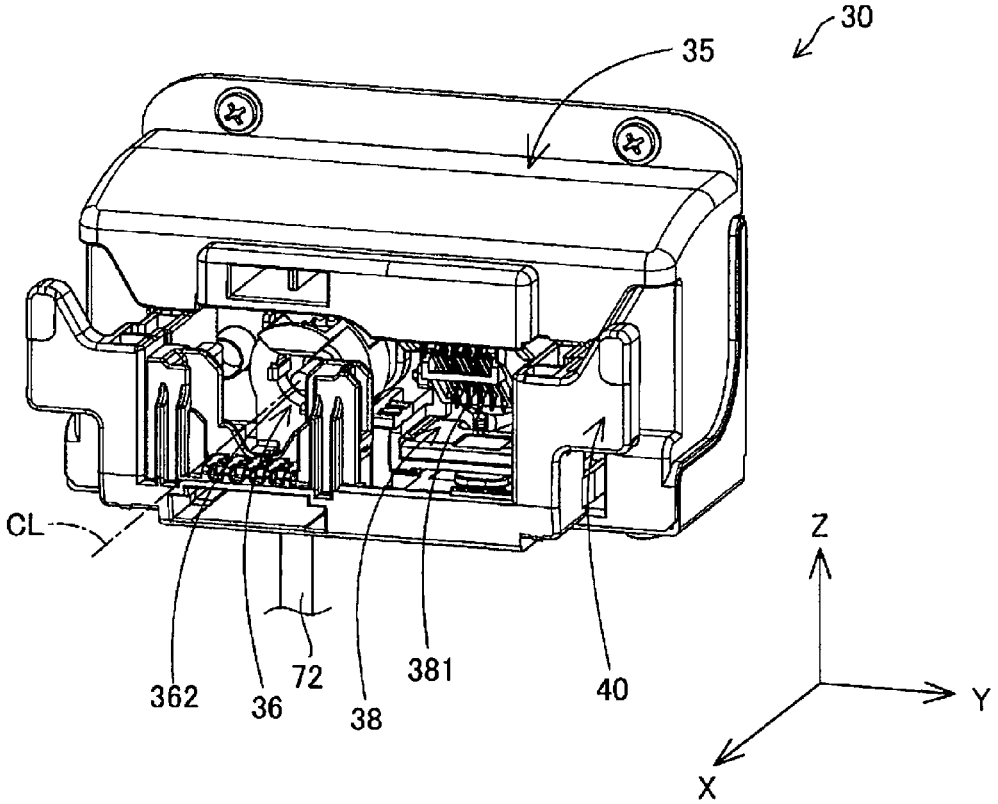
FIG. 5 is a first perspective view of an attachment/detachment unit.
Figure 6:
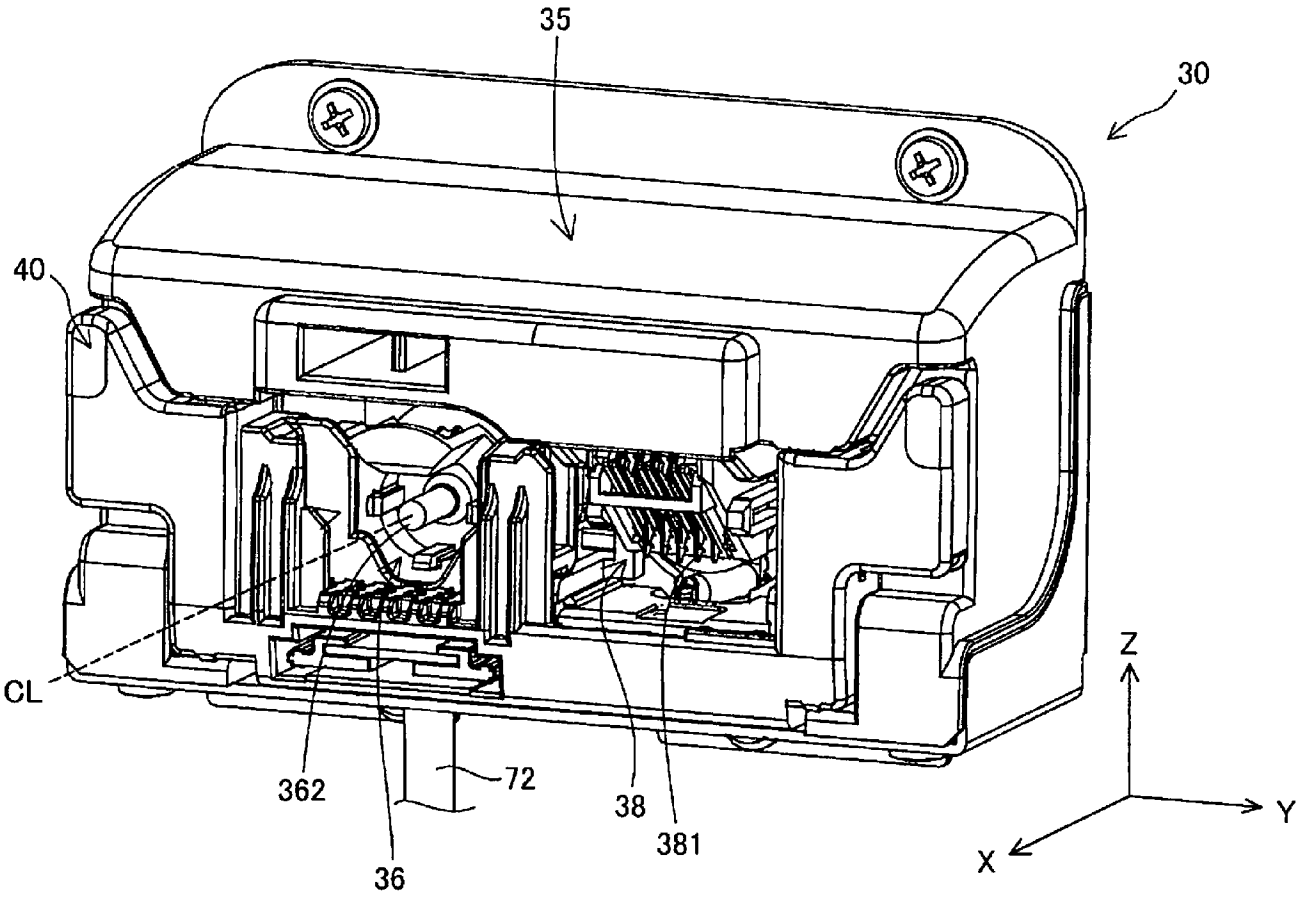
FIG. 6 is a second perspective view of the attachment/detachment unit.
Figure 7:
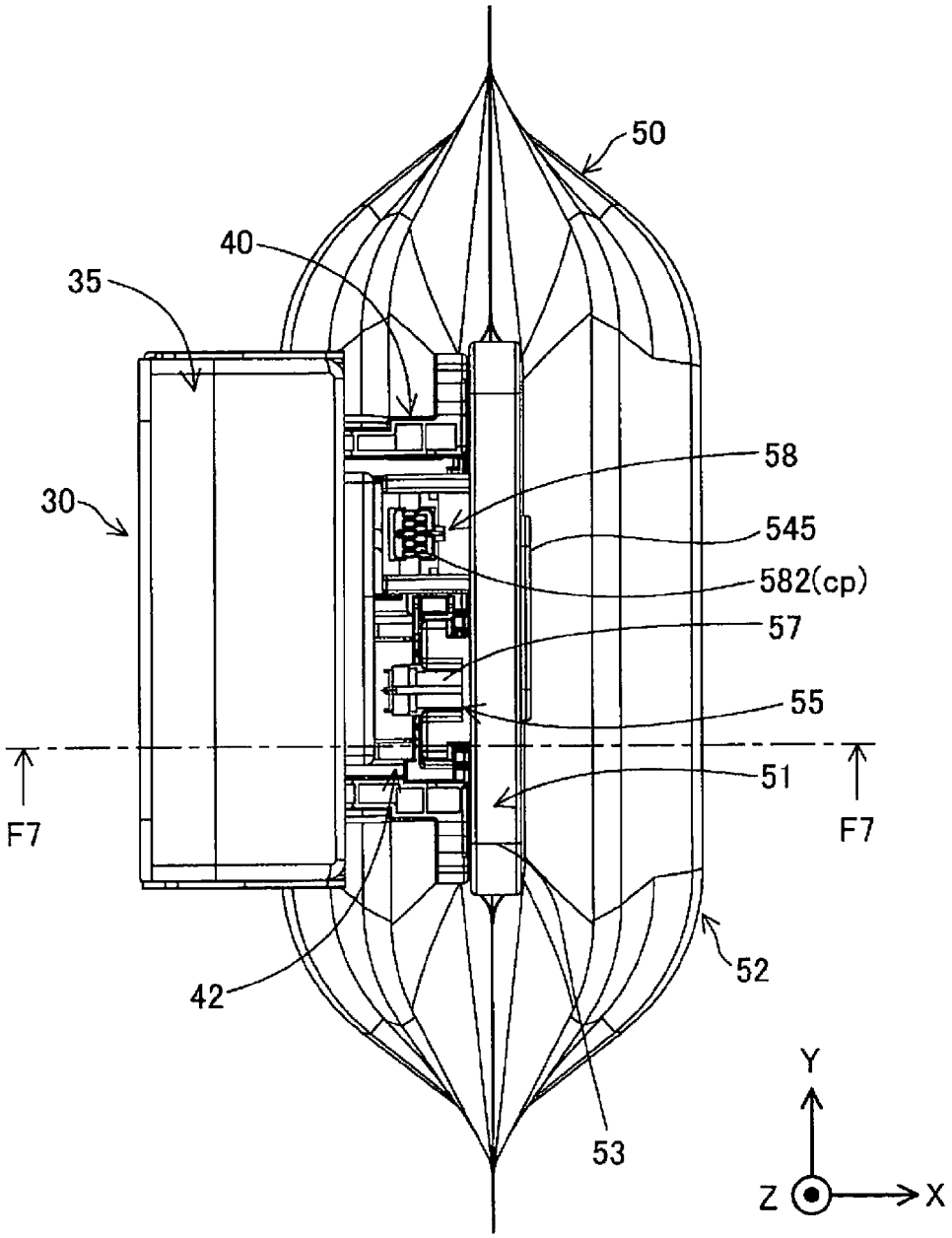
FIG. 7 is a top view of FIG. 5.
Figure 8:
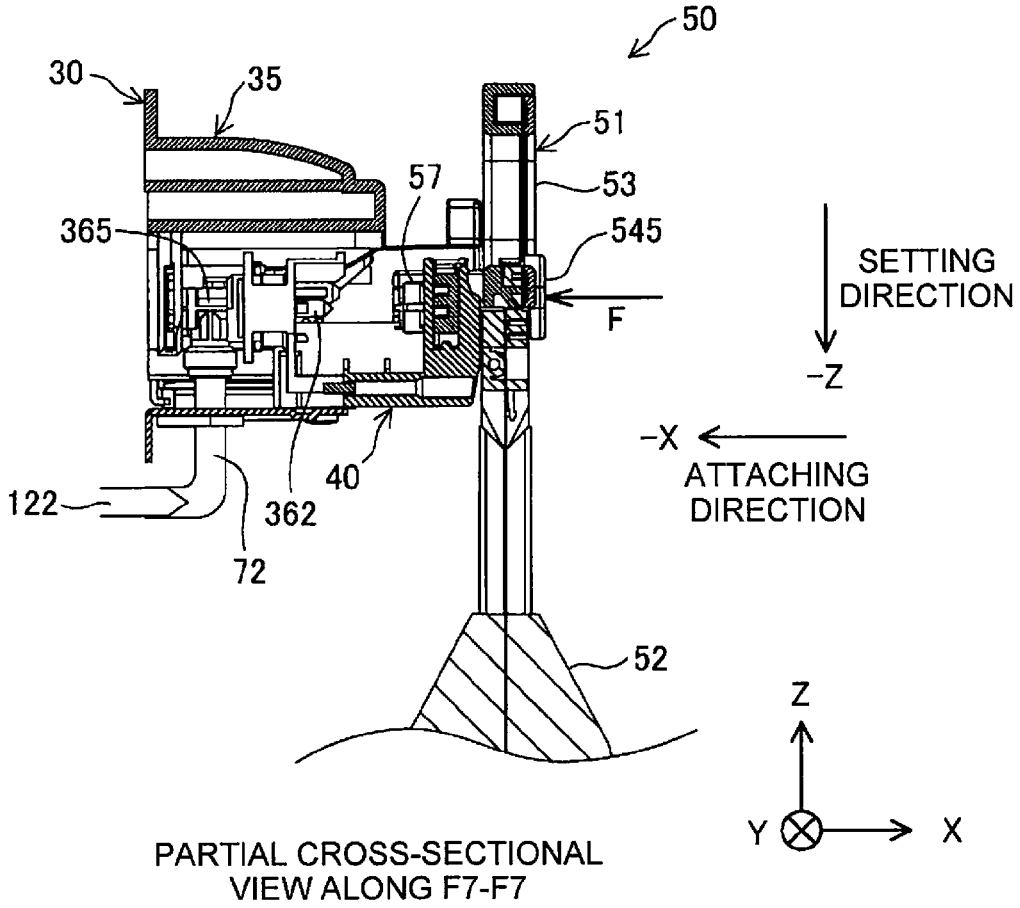
FIG. 8 is a partial cross-sectional view along F7-F7 in FIG. 7.
Figure 9:
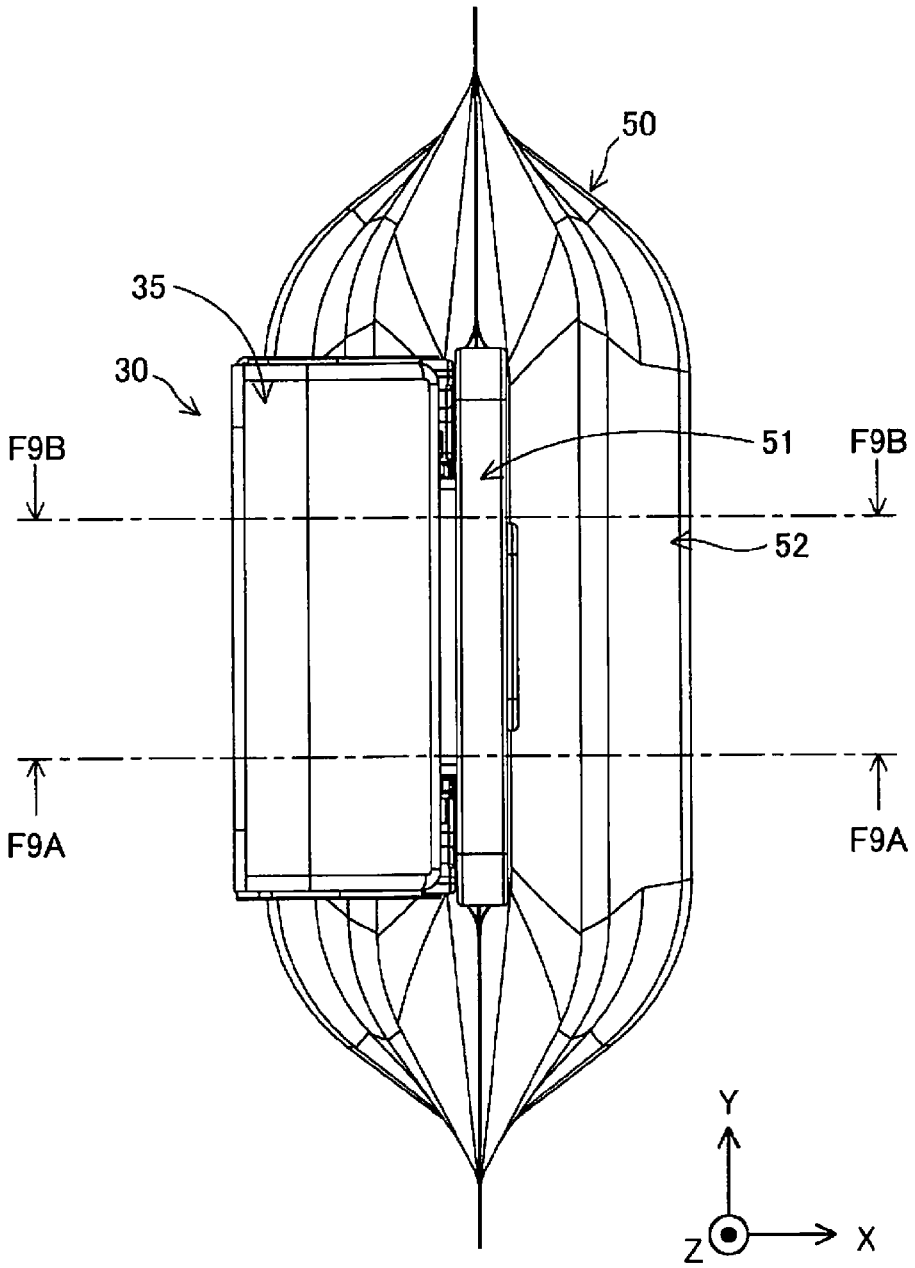
FIG. 9 is a top view of FIG. 6.
Figure 10:
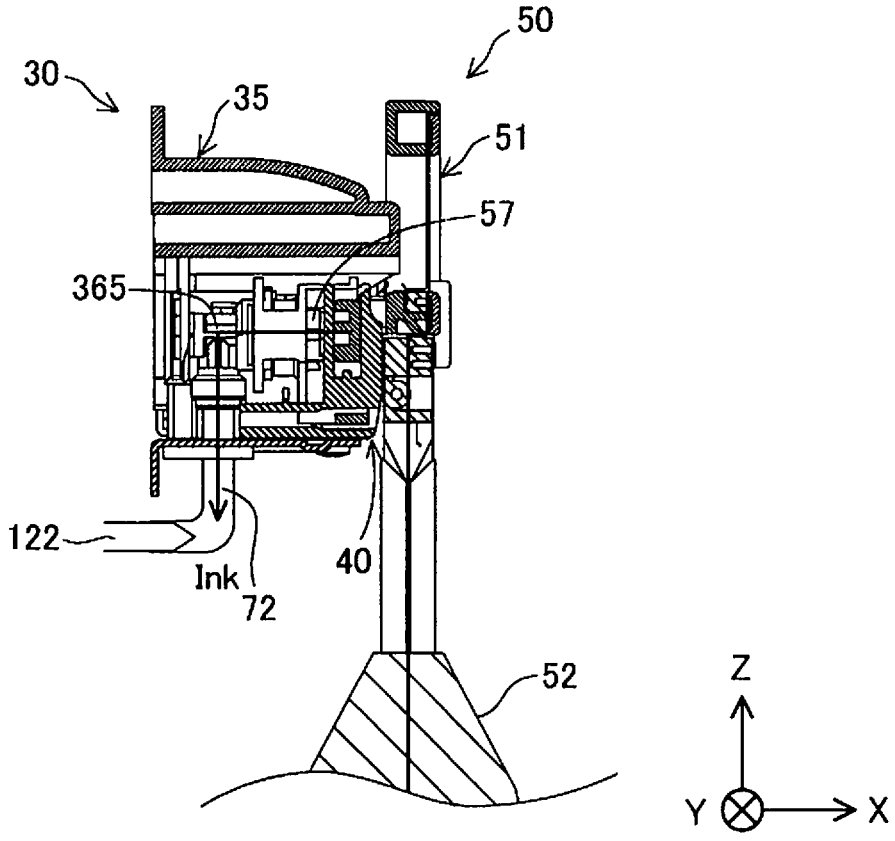
FIG. 10 is a partial cross-sectional view along F9A-F9A in FIG. 9.
Figure 11:
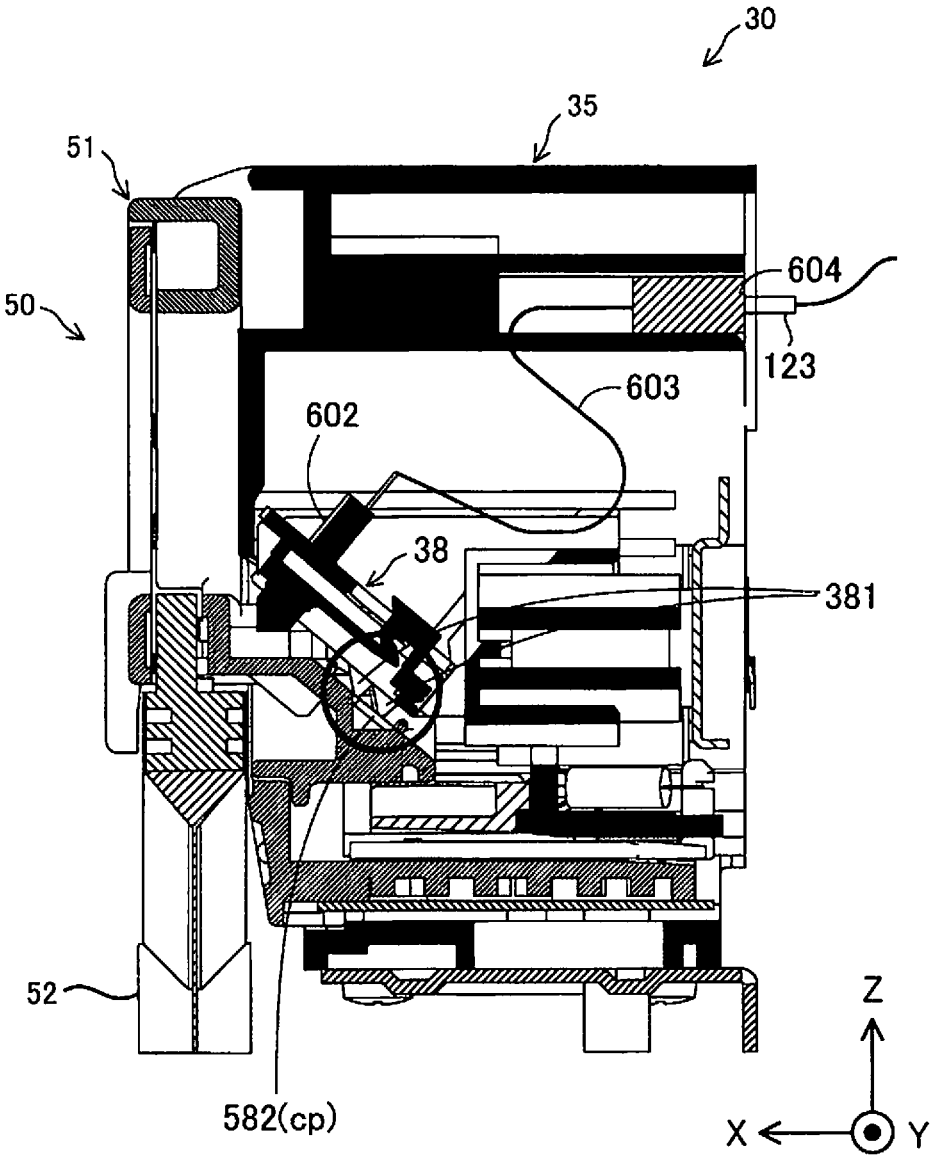
FIG. 11 is a partial cross-sectional view along F9B-F9B in FIG. 9.

A-2. Configuration of Attachment/Detachment Unit 30:

FIG. 5 is a first perspective view of the attachment/detachment unit 30. FIG. 6 is a second perspective view of the attachment/detachment unit 30. FIG. 7 is a top view of FIG. 5. FIG. 8 is a partial cross-sectional view along F7-F7 in FIG. 7. FIG. 9 is a top view of FIG. 6. FIG. 10 is a partial cross-sectional view along F9A-F9A in FIG. 9. FIG. 11 is a partial cross-sectional view along F9B-F9B in FIG. 9. FIG. 5 shows a first state (setting state) in which a movable supporting part (movable member) 40 projects outward by the greatest distance from a fixing member 35. FIG. 6 shows a second state (attached state) in which the movable member 40 is housed in the fixing member 35. FIG. 7 to FIG. 11 also show the liquid container 50 supported by the attachment/detachment unit 30. In FIG. 5 to FIG. 11, XYZ axes that are orthogonal to each other are depicted. The drawings following the above also show the X axis, the Y axis, and the Z axis as needed.

As shown in FIG. 5 and FIG. 6, the attachment/detachment unit 30 includes the fixing member 35 and the movable member 40. The fixing member 35 is supported by the casing 641 by being attached to the casing 641 (FIG. 3) by an attachment member such as a screw. The movable member 40 is supported by the fixing member 35 so as to be movable with respect to the fixing member 35. In other words, the fixing member 35 guides the movement of the movable member 40 in the first direction (−X axis direction) or the second direction (+X axis direction). The first direction is the attaching direction in which the liquid container 50 is attached, and the second direction is the detaching direction in which the liquid container 50 is detached.

As shown in FIG. 6, the fixing member 35 includes a liquid introduction mechanism 36 and a contact mechanism 38. The liquid introduction mechanism 36 and the contact mechanism 38 are arranged next to each other along the Y axis direction.

As shown in FIG. 8, the liquid introduction mechanism 36 includes a liquid introduction part 362 as a flow channel connection part, a flow channel middle part 365, and a flow passage member 72. The liquid introduction part 362 is in communication with the recording head 13 (FIG. 2) of the printer 10. The liquid introduction part 362 is connected to a liquid supply part 57 of the liquid container 50. The liquid introduction part 362 supplies the ink from the liquid supply part 57 to the recording head 13. The liquid introduction part 362 has the shape of a needle, and the ink can pass through the inside thereof. As shown in FIG. 5, the liquid introduction part 362 has a central axis CL, and has the shape of a cylinder extending along the central axis CL direction. The arrangement position of the liquid introduction part 362 is approximately fixed so that connection with the liquid supply part 57 will be made in a desirable state. Also, the liquid introduction part 362 is configured to be able to move slightly in the Y axis direction and the Z axis direction so that the connection with the liquid supply part 57 will be made in an even more desirable state.

The upstream end portion of the flow channel middle part 365 in the direction of the flow of the ink from the liquid container 50 to the printer 10 is connected to the liquid introduction part 362, and the downstream end portion thereof is connected to the flow passage member 72. The ink flowing through the liquid introduction part 362 flows into the flow channel middle part 365.

The flow passage member 72 has a tubular shape, and ink can flow through the inside thereof. The position of the flow passage member 72 is preferably fixed with respect to the unit 60 for the recording apparatus so that connection with the liquid connection part 122 can be easily made. Also, the flow passage member 72 is preferably made of a rigid material so that connection with the liquid connection part 122 can be even more easily made. Examples of the rigid material include a synthetic resin such as polypropylene, polyacetal, or polystyrene, or a metal such as stainless.

As shown in FIG. 10, when the unit-side attachment parts 601 (FIG. 3) of the unit 60 for the recording apparatus are attached to the main body 19 (hereinafter also referred to as "the time of attaching"), the flow passage member 72 is connected to the liquid connection part 122. The liquid container 50 and the recording head 13 are brought into communication as the flow passage member 72 is connected to the liquid connection part 122. The timing of connection is not necessarily simultaneous as the time of attaching. For example, the flow passage member 72 and the liquid connection part 122 may be connected after the main body-side attachment parts 191 and the unit-side attachment parts 601 engage with each other.

As shown in FIG. 6, the contact mechanism 38 includes a plurality of apparatus-side terminals 381, which serve as apparatus-side electrical connection parts. The plurality of apparatus-side terminals 381 are electrically connected to a circuit substrate 582 by being brought into contact with contact portions cp, which serve as container-side electrical connection parts, of the circuit substrate 582 (FIG. 7) of the liquid container 50. In this embodiment, nine apparatus-side terminals 381 are provided in correspondence with nine contact portions cp.

Here, it is assumed that the direction along the central axis CL (the direction in which the liquid introduction part 362 extends) is the X axis direction. The X axis direction is orthogonal to the Z axis direction and the Y axis direction. The plane defined by the X axis direction and the Y axis direction is parallel with the plane defined by the X axis direction and the Y axis direction shown in FIG. 1. With respect to the X axis direction, the direction toward the outside of the printer 10 is defined as +X axis direction, and the direction toward the inside of the printer 10 is defined as −X axis direction. As shown in FIG. 5 and FIG. 6, the movable member 40 is supported by the fixing member 35 so as to be movable in the X axis direction with respect to the fixing member 35. The −X axis direction is the direction in which the movable member 40 gets closer to the fixing member 35, and the +X axis direction is the direction in which the movable member 40 gets away from the fixing member 35.

The liquid container 50 is attached to the attachment/detachment unit 30 by the following two operations. The state in which the liquid container 50 is attached to the attachment/detachment unit 30 is also referred to as "attached state". The attached state is the state in which the liquid supply part 57 (FIG. 7) of the liquid container 50 is connected to the liquid introduction part (liquid introducing needle) 362 of the attachment/detachment unit 30, and the circuit substrate 582 (FIG. 7) of the liquid container 50 is electrically connected to the apparatus-side terminals 381 of the attachment/detachment unit 30. In the attached state, the supply mechanism of the printer 10 can be started up, and accordingly the ink stored in the liquid container 50 is made ready to be supplied to the printer 10.

First Operation (Setting Operation):

After putting the attachment/detachment unit 30 into the first state, the user moves the liquid container 50 in the setting direction, and sets it to the movable member 40 (FIG. 7 and FIG. 8).

Second Operation (Connecting Operation):

After the first operation, the user pushes the movable member 40 toward the fixing member 35 via the liquid container 50, thereby putting the attachment/detachment unit 30 into the second state (FIG. 9 and FIG. 10).

As shown in FIG. 8, the setting direction is the direction including the downward component of the gravity. In this embodiment, the setting direction is the downward gravity direction. The second operation is an operation for moving the movable member 40 in the −X axis direction.

As shown in FIG. 7 and FIG. 8, after putting the attachment/detachment unit 30 into the first state, the user sets the liquid container 50 at a predetermined position of the movable member 40. In the state (setting state) where the liquid container 50 is set, the circuit substrate 582 of a substrate unit 58 of the liquid container 50 is positioned so as to oppose the apparatus-side terminals 381. Also, in the setting state, the liquid supply part 57 of a liquid supply unit 55 included in the liquid container 50 is positioned so as to oppose the liquid introduction part 362. Also, as shown in FIG. 8, in the setting state, the liquid container 50 is supported by the movable member 40 such that the liquid container part 52 is positioned lower in the gravity direction than a container part supporting assembly 51.

After the liquid container 50 is set to the movable member 40, the user presses the liquid container 50 toward the −X axis direction, as indicated by the arrow F in FIG. 8. Thus, the liquid container 50 and the movable member 40 are moved in the attaching direction (−X axis direction). As shown in FIG. 10, when the attachment/detachment unit 30 is in the second state, the liquid introduction part 362 is inserted (connected) to the inside of the liquid supply part 57. Also, in the second state, as shown in FIG. 11, the contact portions cp of the circuit substrate 582 and the apparatus-side terminals 381 are brought into contact, and thus the circuit substrate 582 and the apparatus-side terminals 381 are electrically connected.

When the attachment/detachment unit 30 is in the second state, the movement of the movable member 40 toward the +X axis direction with respect to the fixing member 35 is regulated by a lock mechanism (not shown in the drawings) of the attachment/detachment unit 30. Note that in the second state, the lock mechanism is unlocked by the movable member 40 pressed against the fixing member 35 in the inward direction (−X axis direction, the first direction). Thus, the state of the attachment/detachment unit 30 can be switched from the second state to the first state by moving the movable member 40 so as to project outward (in the +X axis direction) from the fixing member 35.

As shown in FIG. 11, the contact mechanism 38 further includes a connector 602 electrically connected to the apparatus-side terminals 381, wires 603 electrically connected to the connector 602, and a connection connector 604 electrically connected to the wires 603. The connection connector 604 is electrically connected to the electrical connection part 123 at the time of attaching the unit 60 for the recording apparatus to the main body 19. The position of the connection connector 604 is preferably fixed with respect to the unit 60 for the recording apparatus so that connection with the electrical connection part 123 can be easily made. The connection connector 604 is connected to the electrical connection part 123, and accordingly the circuit substrate 582 and the control part 18 can exchange various kinds of signals. For example, information about the liquid container 50 (e.g., the amount of remaining ink, the color of ink) stored in the circuit substrate 582 is transmitted to the control part 18. Note that the timing of connection is not necessarily simultaneous as the time of attaching. For example, the connection connector 604 and electrical connection part 123 may be connected after the main body-side attachment parts 191 and the unit-side attachment parts 601 engage with each other.

Figure 12:
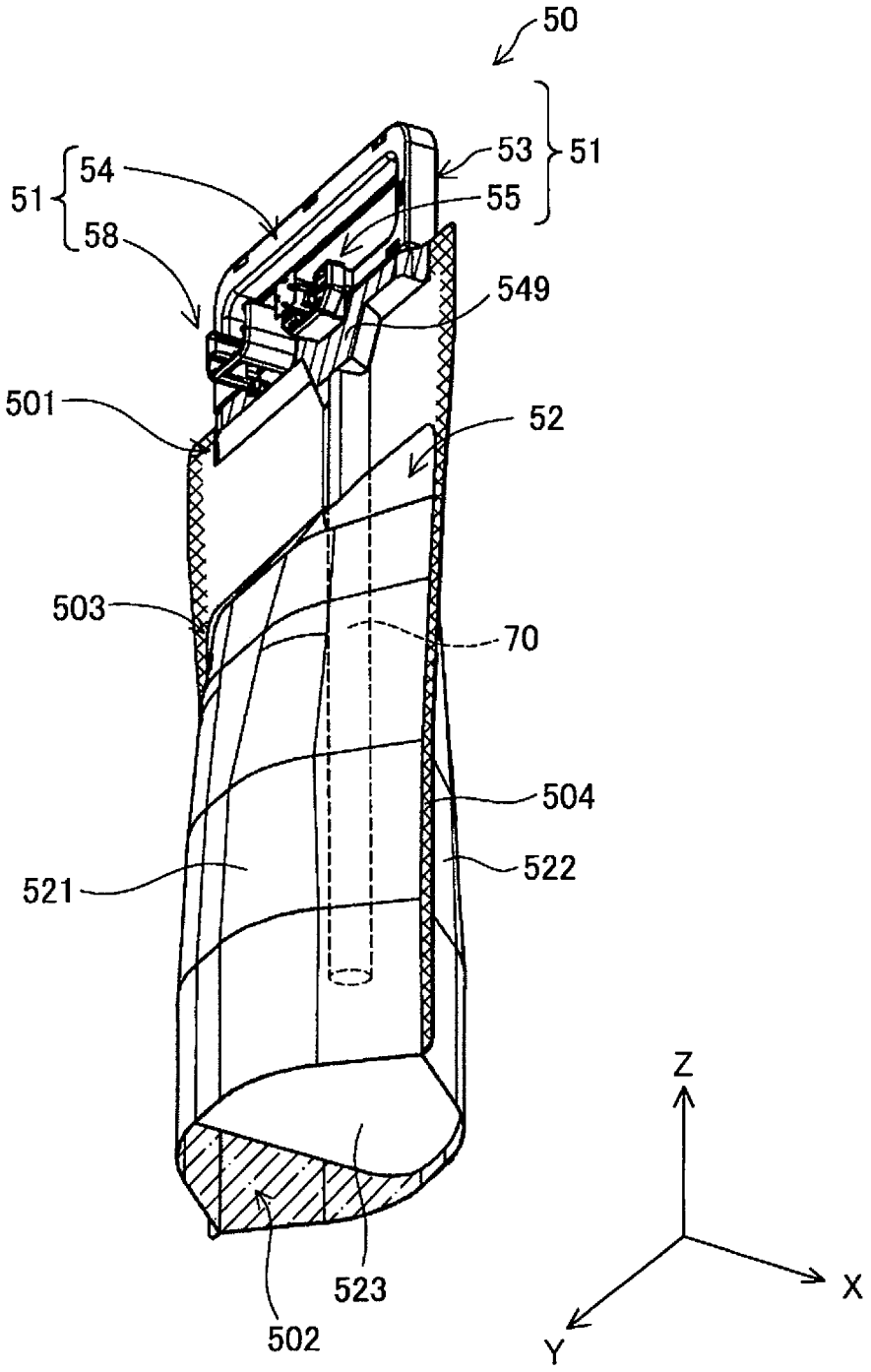
FIG. 12 is a perspective view of a liquid container.
Figure 13:
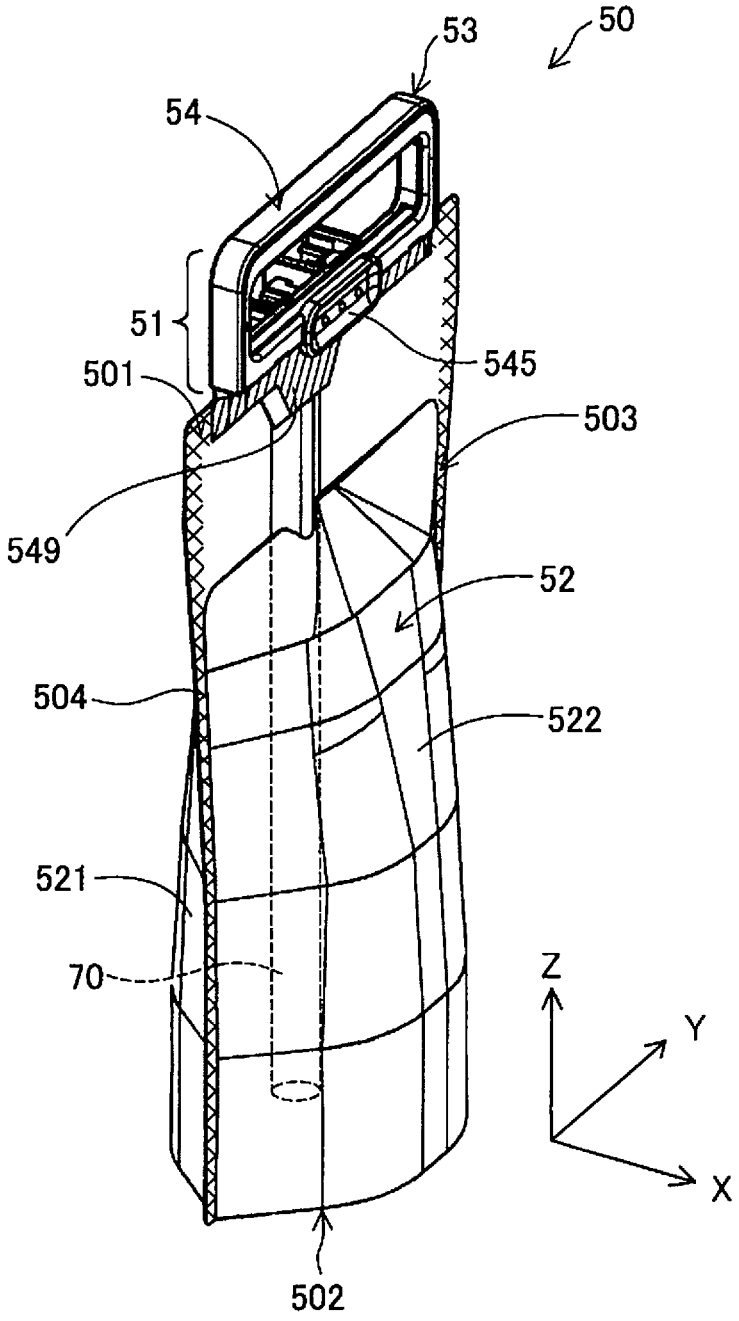
FIG. 13 is a perspective view of a liquid container.
Figure 14:
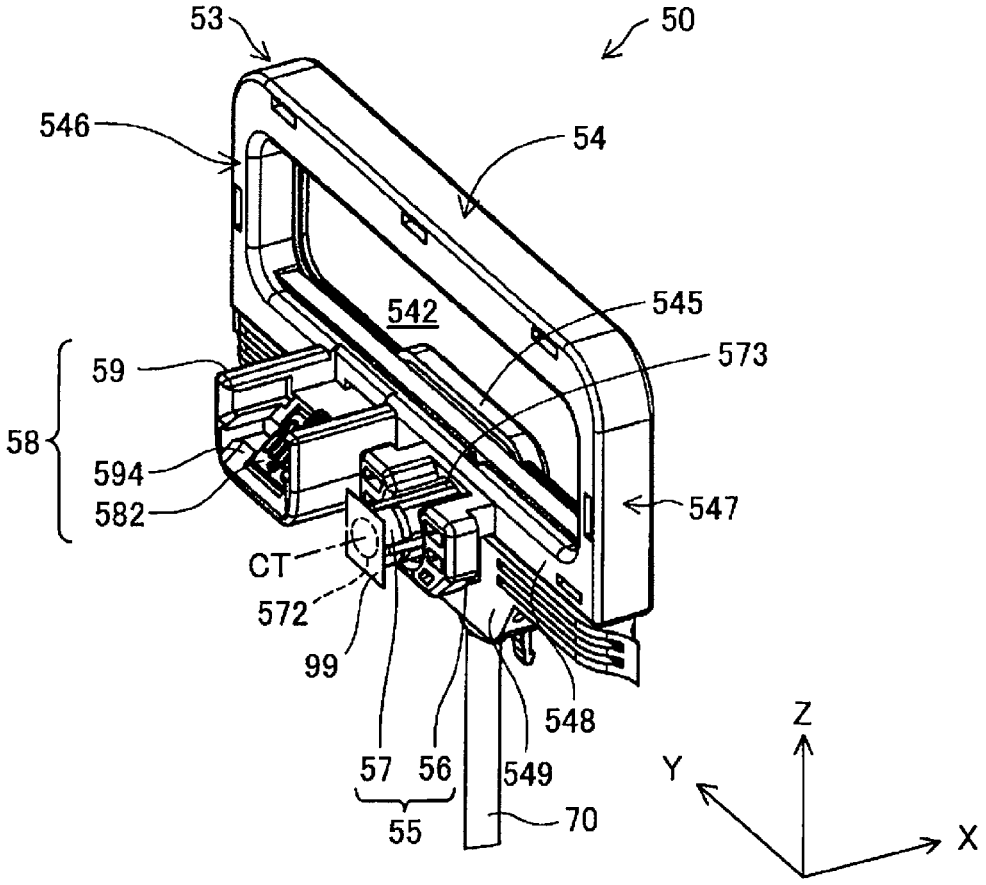
FIG. 14 is a diagram illustrating a liquid container.
Figure 15:
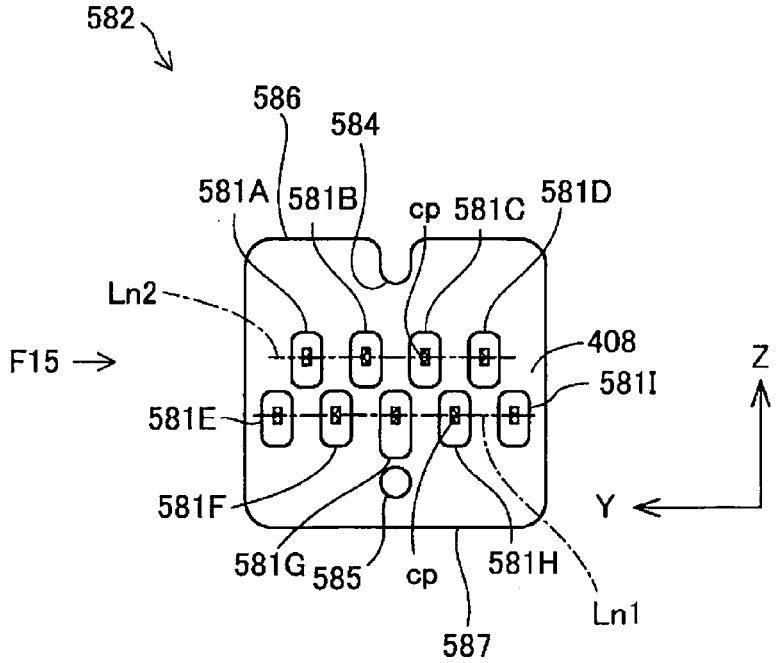
FIG. 15 is a diagram illustrating a circuit substrate.
Figure 16:
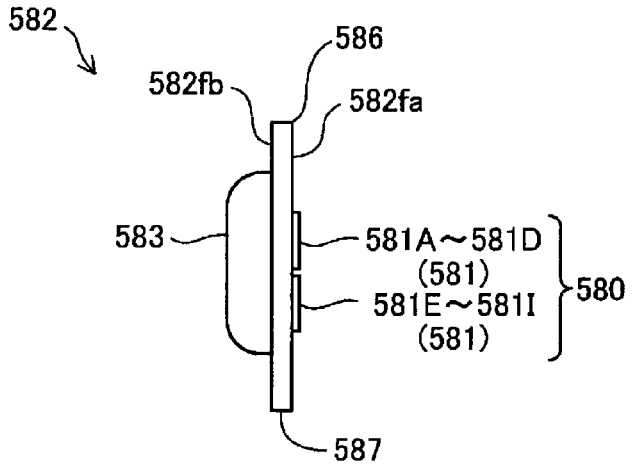
FIG. 16 is a view in the direction of arrow F15 in FIG. 15.

A-3. Configuration of Liquid Container 50:

FIG. 12 is a perspective view of the liquid container 50. FIG. 13 is a perspective view of the liquid container 50. FIG. 14 is a diagram illustrating the liquid container 50. FIG. 15 is a diagram illustrating the circuit substrate 582. FIG. 16 is a view in the direction of arrow F15 in FIG. 15. FIG. 14 is a diagram showing the liquid container 50 from which the liquid container part 52 has been removed. FIG. 12 to FIG. 16 are provided with XYZ axes when the liquid container 50 is attached to the attachment/detachment unit 30 as needed.

The X axis direction, the Y axis direction, and the Z axis direction can be defined as follows. When the liquid container 50 is in the attached state, the Z axis direction is the direction of gravity (vertical direction). The +Z axis direction is the upward gravity direction (vertically upward direction), and the −Z axis direction is the downward gravity direction (vertically downward direction). The X axis direction is the horizontal direction. The −X axis direction is the attaching direction (the first direction) in which the liquid container 50 is attached to the printer 10 after the liquid container 50 is set to the attachment/detachment unit 30. The +X axis direction is the detaching direction in which the liquid container 50 is detached from the printer 10. Although the attaching direction in this embodiment is the −X axis direction, which is the horizontal direction, the attaching direction is not limited to this direction. The attaching direction only needs to be the direction including a horizontal direction component. The Y axis direction is the direction that is orthogonal to the direction of gravity (Z axis direction) and the X axis direction. The Z axis direction is the "height direction" of the liquid container 50. The X axis direction is the "thickness direction" of the liquid container 50. The Y axis direction is the "width direction" of the liquid container 50.

As shown in FIG. 12, the liquid container 50 includes the container part supporting assembly 51, the liquid container part 52 and a flow channel forming member 70. The container part supporting assembly 51 includes a handle part 53, the liquid supply unit 55, and the substrate unit 58. The handle part 53 is a member having the shape of a frame having an opening facing toward the X axis direction.

The liquid container part 52 is capable of storing ink. The liquid container part 52 is attached to the container part supporting assembly 51, with the external surface being exposed. In other words, the liquid container part 52 is not housed in a casing or the like, and is configured to be externally visible. The liquid container part 52 is flexible, and the capacity thereof decreases as the ink stored therein decreases.

The liquid container part 52 includes a first sheet 521 (FIG. 12), a second sheet 522 (FIG. 13), and a third sheet 523 (FIG. 12). The first sheet 521 to the third sheet 523 partition the space for storing the ink therein. When the liquid container 50 is in the attached state, the third sheet 523 constitutes the bottom part of the liquid container part 52. Also, in the attached state, each of the first sheet 521 and the second sheet 522 constitutes a side face part of the liquid container part 52.

Here, as shown in FIG. 12, of the liquid container part 52, the portion to which the container part supporting assembly 51 is attached is defined as one end portion (upper end portion) 501, and the part opposing the one end portion 501 is defined as the other end portion (bottom end portion) 502. Also, of the liquid container part 52, the portion on one side (in the +Y axis direction) is defined as a first side end portion 503, and the portion on the other side (in the −Y axis direction) is defined as a second side end portion 504.

The respective peripheral areas of the first sheet 521 and the second sheet 522 are partially fused to each other. More specifically, their respective peripheral areas are fused at the one end portion 501, the first side end portion 503, and the second side end portion 504. To facilitate understanding, in FIG. 12 and FIG. 13, the area where the first sheet 521 and the second sheet 522 are fused to each other is indicated by cross hatching. To the one end portion 501 of the liquid container part 52, the container part supporting assembly 51 (specifically, an attaching part 549) is fused. To facilitate understanding, in FIG. 12 and FIG. 13, the area where the container part supporting assembly 51, the first sheet 521, and the second sheet 522 are fused is indicated by single hatching with solid lines.

As shown in FIG. 12, the third sheet 523 is fused to portions of the respective peripheral areas of the first sheet 521 and the second sheet 522. These fused portions are indicated by single hatching with dot-and-dash lines. As described above, the liquid container part 52 according to this embodiment is of the type with three sheets 521, 522, and 523 attached to each other by fusing or the like (so-called a pouch type with a bottom).

Each of the first sheet 521 to the third sheet 523 is a flexible member. The material (constituent) of the first sheet 521 to the third sheet 523 is, for example, polyethylene terephthalate (PET), nylon, or polyethylene.

Although the liquid container part 52 in this embodiment is of the type with the first sheet 521 to the third sheet 523 attached to each other by fusing or the like, the third sheet 523 may be omitted, and the liquid container part 52 may be of the type with the first sheet 521 and the second sheet 522 attached to each other by fusing or the like (so-called pillow type). Alternatively, the liquid container part 52 may be of the type with the four sheets constituting the sides attached to each other (so-called gusset type).

As shown in FIG. 12, the flow channel forming member 70 is disposed within the liquid container part 52. The flow channel forming member 70 is a tube. The flow channel forming member 70 forms a flow channel therein for bringing the inside of the liquid container part 52 and the liquid supply part 57 into communication. The ink in the liquid container part 52 passes through the flow channel in the flow channel forming member 70 and is thus supplied to the liquid supply part 57.

As shown in FIG. 14, the handle part 53 includes a grip part 54 located at the end portion in the +Z axis direction, the attaching part 549 located at the end portion in the −Z axis direction, and a base part 548 located between the grip part 54 and the attaching part 549 with respect to the Z axis direction. The handle part 53 further includes a first connection part 546 located at the end portion in the +Y axis direction, and a second connection part 547 located at the end portion in the −Y axis direction.

Each of the grip part 54, the first connection part 546, the second connection part 547, and the base part 548 has the shape of a rod. The grip part 54, the first connection part 546, the second connection part 547, and the base part 548 form a member having the shape of a frame. Thus, a receiving space 542 having a substantially rectangular shape for receiving a hand of the user is defined in the handle part 53.

The grip part 54 is the part at which the user grips the liquid container 50. The grip part 54 extends along the Y axis direction.

The first connection part 546 is a member extending from one end portion of the grip part 54 in the Y axis direction towards the base part 548 (toward the −Z axis direction, i.e., toward the liquid container part 52 shown in FIG. 12). The second connection part 547 is a member extending from the other end portion of the grip part 54 in the Y axis direction toward the base part 548 (toward −Z axis direction, i.e., toward the liquid container part 52 shown in FIG. 7). The base part 548 opposes the grip part 54 with the receiving space 542 therebetween. The base part 548 extends along the Y axis direction. To the base part 548, a positioning part 56, a circuit substrate holding part (a contact portion positioning part) 59, and a pressing part 545, which will be described later, are attached.

The attaching part 549 extends along the Y axis direction. The attaching part 549 is the part to which the one end portion 501 of the liquid container part 52 (FIG. 12) is attached by fusing or the like.

As shown in FIG. 14, the liquid supply unit 55 includes the liquid supply part 57 and the positioning part 56. Note that the positioning part 56 is configured as a part that is separated from the liquid supply part 57, and a small gap is formed between the positioning part 56 and the liquid supply part 57. The liquid supply unit 55 is formed so as to project outward (in the −X axis direction) from the handle part 53.

The liquid supply part 57 is in communication with the inside of the liquid container part 52, and supplies the ink in the liquid container part 52 to the printer 10. Specifically, the ink in the liquid container part 52 passes through the flow channel forming member 70 and the flow channel (not shown in the drawings) inside the handle part 53, and reaches the liquid supply part 57. The ink that has reached the liquid supply part 57 is then supplied to the recording head 13 of the printer 10 via the flow channels 362, 365, and 72 in the attachment/detachment unit 30.

The liquid supply part 57 has a liquid supply opening 572 at one end and a supply connection part 573 at the other end. The liquid supply opening 572 is in communication with the inside of the liquid container part 52, and causes the ink stored in the liquid container part 52 to flow to the outside (printer 10). The liquid supply part 57 is a cylindrical member (annular member) extending along the X axis direction (the direction along a central shaft CT). The liquid supply part 57 is formed so as to project outward (in the −X axis direction) from the handle part 53.

The liquid supply part 57 has the central shaft CT. The central shaft CT is parallel with the X axis direction. Here, with respect to the X axis direction, the direction from the liquid supply opening 572 to the supply connection part 573 is defined as +X axis direction, and the direction from the supply connection part 573 to the liquid supply opening 572 is defined as −X axis direction. A valve mechanism for opening and closing the internal flow channel of the liquid supply part 57 is provided inside the liquid supply part 57. The valve mechanism opens the flow channel when the liquid introduction part 362 (FIG. 8) is inserted into the liquid supply part 57 so that the ink can be supplied from the liquid supply part 57 to the liquid introduction part 362.

When the liquid container 50 is in unused state, the liquid supply opening 572 is covered with a film 99. The ink is thus prevented from flowing to the outside from the liquid supply opening 572 before the liquid container 50 is attached to the attachment/detachment unit 30 (FIG. 5). The film 99 gets ripped by the liquid introduction part 362 (FIG. 8) when the liquid container 50 is attached to the attachment/detachment unit 30.

As shown in FIG. 14, when the liquid container 50 is connected to the printer 10, the positioning part 56 roughly determines the position of the liquid container 50 including the liquid supply opening 572, with respect to the printer 10. The positioning part 56 is provided integrally with the handle part 53. In this embodiment, the positioning part 56 and the handle part 53 are formed by casting, and the positioning part 56 is thereby provided integrally with the handle part 53. Here, "provided integrally" means that the positioning part 56 is provided in the handle part 53 so as to move along with the movement of the handle part 53. In another embodiment, the positioning part 56 may be provided integrally with the handle part 53 by attaching the positioning part 56 to the handle part 53 by fusing or the like. Although the positioning part 56 is provided in the vicinity of the liquid supply opening 572 so as to surround the liquid supply opening 572 along the circumferential direction except for above the liquid supply opening 572, when the handle part 53 is made of a material that is not readily deformable, the positioning part 56 may be located at, of the handle part 53, a position that is more or less distant from the liquid supply opening 572. The positioning part 56 projects from the handle part 53 in the −X axis direction.

The positioning part 56 is located in the vicinity of the liquid supply opening 572. Also, at least a portion of the positioning part 56 is located on the liquid supply opening 572, on the side of the liquid container part 52 (in the −Z axis direction). In this embodiment, the positioning part 56 is located around the liquid supply part 57 with the central shaft CT at the center. Specifically, the positioning part 56 is located around the liquid supply part 57 except for a portion on the side of the grip part 54.

When the liquid container 50 is attached to the printer 10, the positioning part 56 roughly determines the position of the liquid container 50 by being brought into contact with the movable member 40 of the attachment/detachment unit 30 (FIG. 5) and thereby regulating the movement of the liquid supply part 57.

As shown in FIG. 14, the substrate unit 58 includes the circuit substrate 582 and the contact portion positioning part 59. The substrate unit 58 is formed so as to project outward (in the −X axis direction) from the handle part 53. The projecting direction of the substrate unit 58 is the same as the projecting direction of the liquid supply part 57 (−X axis direction). Note that the projecting direction of the substrate unit 58 and the projecting direction of the liquid supply part 57 are not necessarily the same, and it is only required that they are substantially parallel with each other. The substrate unit 58 is arranged next to the liquid supply unit 55 along the Y axis direction.

The contact portion positioning part 59 positions the circuit substrate 582. The contact portion positioning part 59 is provided integrally with the handle part 53. In this embodiment, the contact portion positioning part 59 and the handle part 53 are formed by casting, and the contact portion positioning part 59 is thereby provided integrally with the handle part 53. Here, "provided integrally" means that the contact portion positioning part 59 is provided in the handle part 53 so as to move along with the movement of the handle part 53. In another embodiment, the contact portion positioning part 59 may be provided integrally with the handle part 53 by attaching the contact portion positioning part 59 to the handle part 53 by fusing or the like.

The contact portion positioning part 59 has a concave shape with an opening provided on the +Z axis direction side (on the side of the grip part 54). A bottom part 594 of the concave shape is inclined with respect to the X axis direction. The circuit substrate 582 is attached to the bottom part 594, and accordingly the circuit substrate 582 is held in the state of being inclined with respect to the horizontal direction, by the contact portion positioning part 59.

As shown in FIG. 15, a boss groove 584 is formed in an upper end portion 586 of the circuit substrate 582 in the +Z axis direction, and a boss hole 585 is formed in a lower end portion 587 of the circuit substrate 582 in the −Z axis direction. The circuit substrate 582 is fixed to the bottom part 594 (FIG. 14) by using the boss groove 584 and the boss hole 585.

As shown in FIG. 15 and FIG. 16, the circuit substrate 582 includes a liquid container-side terminals 580 provided on a front surface 582*fa* and a storage device 583 provided on a rear surface 582*fb*. The front surface 582*fa* and the rear surface 582*fb* are flat surfaces.

The liquid container-side terminals 580 include nine terminals 581A to 581I. The storage device 583 stores information about the liquid container 50 (e.g., the amount of remaining ink, the color of ink). The storage device 583 and the nine terminals 581A to 581I are electrically connected.

As shown in FIG. 15, each of the nine liquid container-side terminals 581A to 581I is formed to have a substantially rectangular shape. The nine liquid container-side terminals 581A to 581I are arranged so as to form two rows Ln1 and Ln2 that are separate from each other in the Z axis direction, which is the direction that intersects with the attaching direction (−X axis direction). The rows Ln1 and Ln2 are parallel with the Y axis direction.

A contact portion cp is formed in the central portion of each of the liquid container-side terminals 581A to 581I, which is brought into contact with the corresponding one of the apparatus-side terminals 381. The rows Ln1 and Ln2 may be considered as rows composed of a plurality of contact portions cp. Note that when the nine liquid container-side terminals 581A to 581I are referred to without being distinguished from each other, the sign "581" is used.

A-4. Advantageous Effects:

In the above-described first embodiment, as shown in FIG. 3 and FIG. 8, the unit 60 for the recording apparatus includes the liquid introduction part 362 as a flow channel connection part to which the liquid supply part 57 is connected. Therefore, the liquid container 50 can be attached to or detached from the printer 10 by connecting the liquid supply part 57 to the liquid introduction part 362 or removing the liquid supply part 57 from the liquid introduction part 362. In particular, in the above-described first embodiment, as shown in FIG. 3 and FIG. 5, the liquid introduction part 362 is positioned inside the casing 641 in which the liquid containers 50 are housed. Therefore, the liquid container 50 can be housed in the casing 641 by performing the operation for connecting the liquid supply part 57 to the liquid introduction part 362. As described above, according to this embodiment, the operability of the liquid container 50 with respect to the printer 10 can be improved.

Also, in the above-described first embodiment, the unit 60 for the recording apparatus includes the recording medium positioning unit 62 in addition to the liquid supply apparatus 64. The unit 60 for the recording apparatus is configured to be detachable from the main body 19. Therefore, the operability of the unit 60 for the recording apparatus is improved compared to the case where the liquid supply apparatus 64 and the recording medium positioning unit 62 are separately attached/detached. Thus, the members 62 and 64 can be easily attached to and detached from the main body 19 of the printer 10. Also, by attaching the unit 60 for the recording apparatus to the main body 19, it becomes easy to increase the number of the liquid containers 50. For example, in the case where another liquid supply apparatus 64 is already fixed to the right side face 106 or the left side face 104 of the printer 10, the demand for adding a new liquid container 50 might arise. In this case, the attachment/detachment unit 30 for attaching/detaching the liquid container 50 can be added by attaching the unit 60 for the recording apparatus to the main body 19. As a result, it becomes easy to, for example, use many types of ink such as many colors of ink, and increase the amount of ink that can be used by the printer 10. In this way, since the printer 10 according to this embodiment includes the unit 60 for the recording apparatus attachable to and detachable from the main body 19, it is easy to change the specifications of the printer 10 according to the demand by the user, such as whether or not to perform rear side paper feeding, and whether or not to increase the types of the liquid containers.

Also, the recording medium positioning unit 62 usually has a shorter length than the main body 19 (e.g., FIG. 3) in the top-to-bottom direction. Therefore, when only the recording medium positioning unit 62 is attached to the main body 19, a space occurs above or below the recording medium positioning unit 62. In this embodiment, as shown in FIG. 3, the unit 60 for the recording apparatus is configured such that the liquid supply apparatus 64 is located below the recording medium positioning unit 62. Thus, the liquid supply apparatus 64 including the recording medium positioning unit 62 as the medium positioning part and the liquid introduction part 362 as the flow channel connection part can be located by effectively using the space occurring in the printer 10 in the top-to-bottom direction, and the increase in size of the recording medium positioning unit 62 in the horizontal direction can be suppressed.

Also, in the above-described first embodiment, as shown in FIG. 4, the paper feed tray 622 also serves as a two-sided paper feed part for turning over the piece of printing paper P from one side to the other side. As a result, it is easy to perform recording on both sides of the piece of printing paper P.

Figure 17:
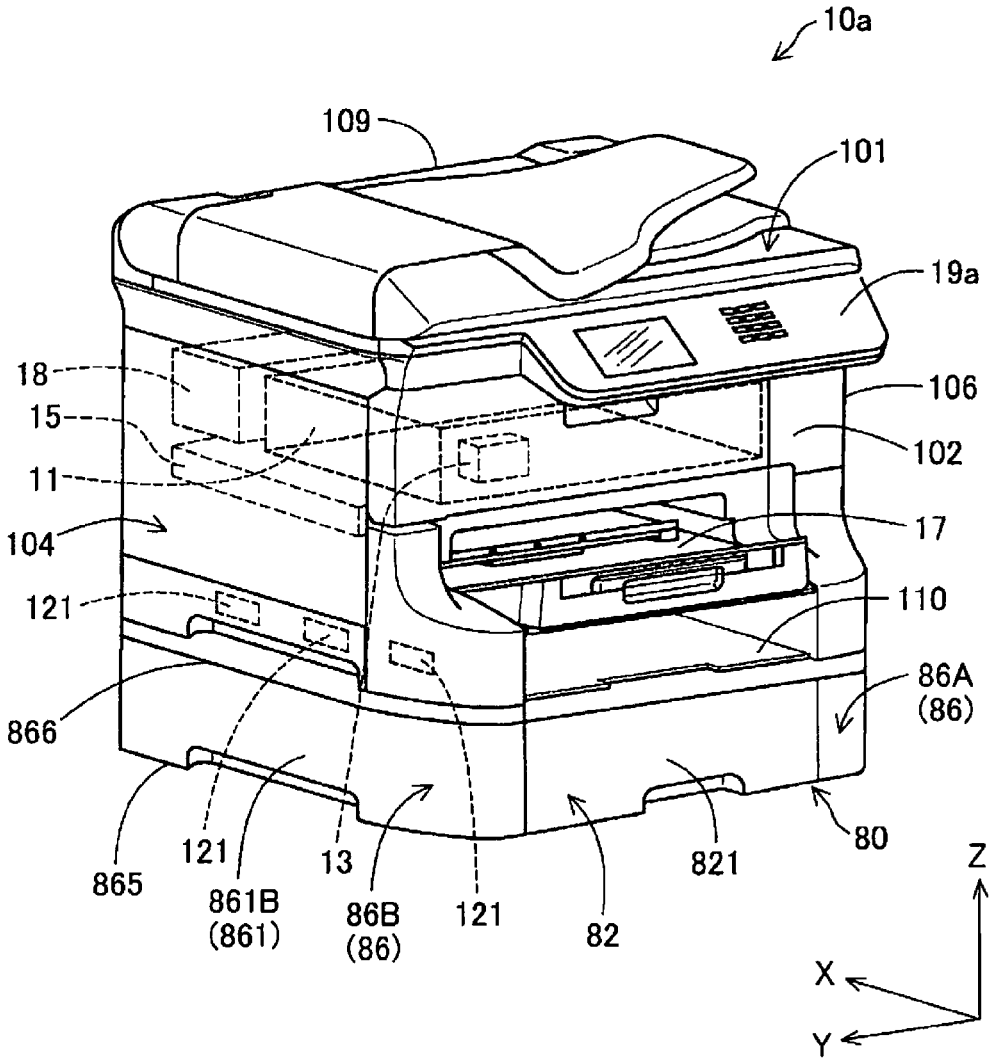
FIG. 17 is a perspective view illustrating a printer as a second embodiment.

B. Second Embodiment:

FIG. 17 is a perspective view illustrating a printer 10*a* as a second embodiment of the invention. The difference of the printer 10*a* according to the second embodiment from the printer 10 (FIG. 1) according to the first embodiment is the arrangement position of the connection unit 121 and that a positioning unit 80 for the recording apparatus is newly provided instead of the unit 60 for the recording apparatus. Since the other elements are the same as the elements of the printer 10 according to the first embodiment, the same elements as the first embodiment are given the same reference signs and the description thereof is omitted.

The connection unit 121 is provided on the bottom face (the face on the side of the −Z axis direction) of a main body 19*a*. As in the first embodiment, the connection unit 121 includes the liquid connection part 122 and the electrical connection part 123.

The positioning unit 80 for the recording apparatus is a housing substantially having the shape of a rectangular cuboid. The positioning unit 80 for the recording apparatus is located below the main body 19*a* in the top-to-bottom direction, and another positioning unit 80 for the recording apparatus can be added to the main body 19*a*. A plurality of positioning units 80 for the recording apparatus can be stacked below the main body 19*a*. Attachment of the positioning unit 80 for the recording apparatus is performed by engaging the upper surface of the new positioning unit 80 for the recording apparatus with the lower surface of the main body 19*a* or the lower surface of the already positioned positioning unit 80 for the recording apparatus. Note that attachment of the positioning unit 80 for the recording apparatus is not limited to the above, and it may be attached to the main body 19*a* by a screw or the like. The external size of the main body 19*a* in the horizontal direction and the external size of the positioning unit 80 for the recording apparatus in the horizontal direction are substantially the same.

The positioning unit 80 for the recording apparatus includes a recording medium positioning unit 82 as a medium positioning part, a first liquid supply apparatus 86A, and a second liquid supply apparatus 86B. The first liquid supply apparatus 86A is located in the −Y axis direction of the recording medium positioning unit 82. The second liquid supply apparatus 86B is located in the +Y axis direction of the recording medium positioning unit 82. As described above, the first liquid supply apparatus 86A, the second liquid supply apparatus 86B, and the recording medium positioning unit 82 are arranged next to each other along the horizontal direction. The recording medium positioning unit 82, the first liquid supply apparatus 86A, and the second liquid supply apparatus 86B are integrally formed. Also, the recording medium positioning unit 82, the first liquid supply apparatus 86A, and the second liquid supply apparatus 86B are adjacent to each other. Note that when there is no need to distinguish the first liquid supply apparatus 86A and the second liquid supply apparatus 86B from each other, they may be simply referred to as "liquid supply apparatus 86". Although the first liquid supply apparatus 86A and the second liquid supply apparatus 86B have the same configuration, if the constituent elements of the first liquid supply apparatus 86A and the second liquid supply apparatus 86B are distinguished from each other, "A" or "B" is attached to the end of the reference sign.

The recording medium positioning unit 82 is configured to be movable in the X axis direction (horizontal direction). The user can draw out a recording medium container part 821 by gripping the portion of the recording medium positioning unit 82 that is on the side of the front face 102 and drawing, it in the −X axis direction.

The liquid supply apparatus 86 has a casing 861 in which the liquid container 50 and the attachment/detachment unit 30 are housed. The casing 861 is configured to be openable and closable by rotating an upper end portion 866 about a lower end portion 856 as a pivot. Note that the casing 861 only needs to be openable and closable so that the liquid containers 50 can be attached and detached, and the configuration thereof is not limited to the above. For example, the casing 861 may be configured to be openable and closable by rotating the end portion of the casing 861 in the −X axis direction about the end portion in the +X axis direction.

Figure 18:
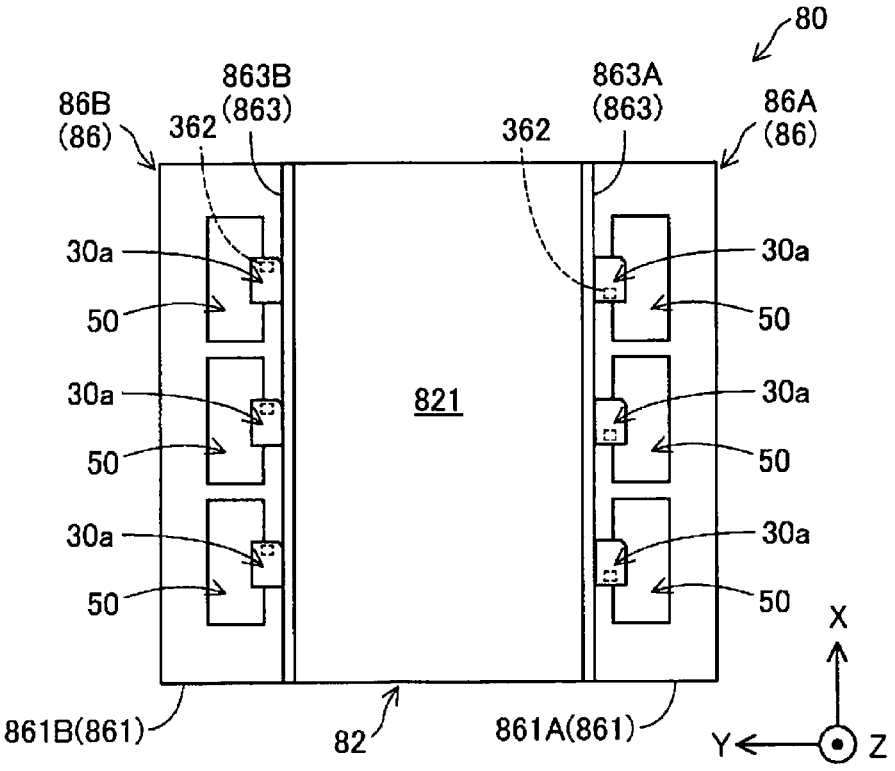
FIG. 18 is a first diagram illustrating a configuration of a positioning unit for a recording apparatus.
Figure 19:
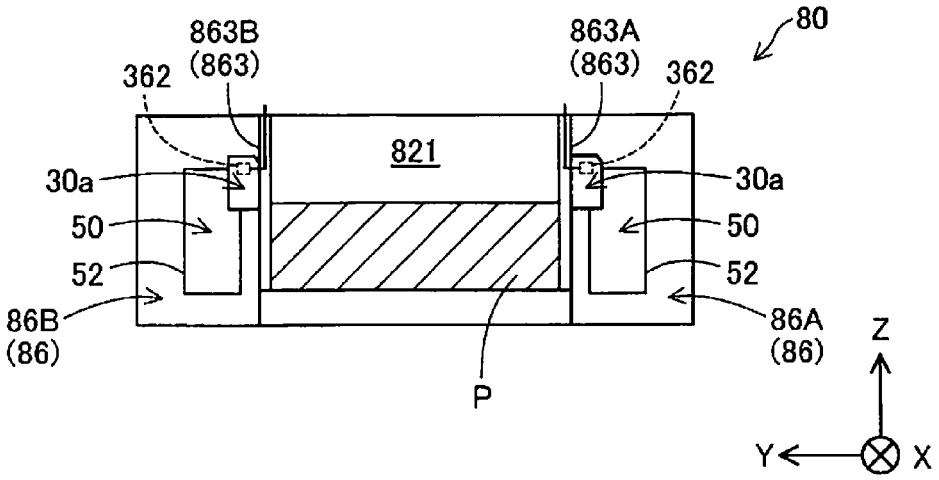
FIG. 19 is a second diagram illustrating a configuration of a positioning unit for a recording apparatus.
Figure 20:
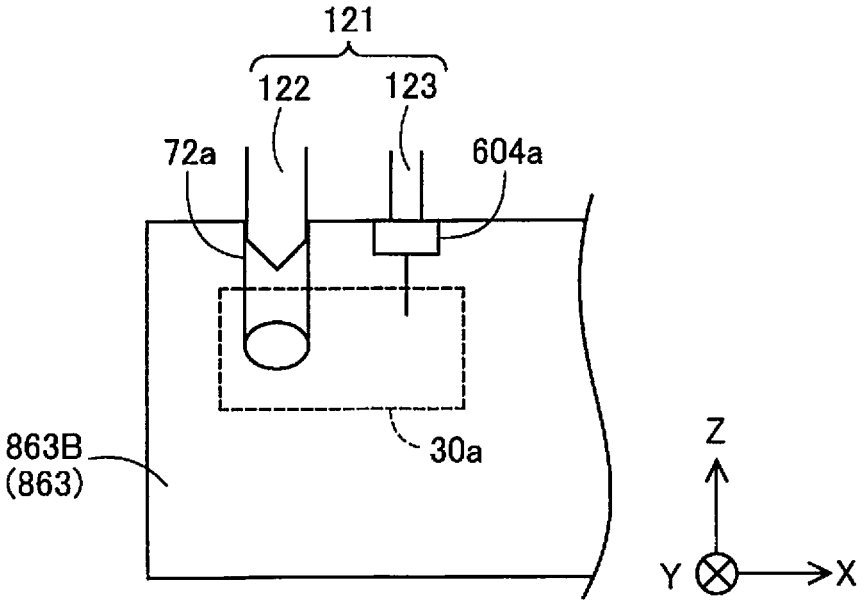
FIG. 20 is a diagram illustrating an attachment/detachment unit.

FIG. 18 is a first diagram illustrating the configuration of the positioning unit 80 for the recording apparatus. FIG. 19 is a second diagram illustrating the configuration of the positioning unit 80 for the recording apparatus. FIG. 20 is a diagram illustrating an attachment/detachment unit 30*a*.

As shown in FIG. 19, the recording medium positioning unit 82 includes a recording medium container part (paper feed cassette) 821 in which a plurality of pieces of printing paper P can be stored. The recording medium container part 821 has a concave shape with an opening provided on the +Z axis direction side. The piece of printing paper P stored in the recording medium container part 821 is conveyed toward the recording head 13 by the conveyance mechanism 15. Then, after printing is performed on the piece of printing paper P by the recording head 13, the piece of printing paper P is ejected onto the discharge tray 17 by the conveyance mechanism 15.

As shown in FIG. 18, each of the first liquid supply apparatus 86A and the second liquid supply apparatus 86B includes three liquid containers 50 and three attachment/detachment units 30*a*. The three liquid containers 50 are arranged along the X axis direction, which is the horizontal direction. The attachment/detachment unit 30*a* according to the second embodiment is different from the attachment/detachment unit 30 according to the first embodiment in the arrangement position of the flow passage member 72 and the arrangement position of the connection connector 604. Since the other elements of the attachment/detachment unit 30*a* are the same as the elements of the attachment/detachment unit 30 according to the first embodiment, the same elements are given the same reference signs and the description thereof is omitted. The direction in which the liquid introduction part 362 and the apparatus-side terminals 381 (FIG. 5) of the attachment/detachment unit 30*a* are arranged is not the Y axis direction as in the first embodiment, but is the X axis direction.

The attachment/detachment unit 30*a* of the first liquid supply apparatus 86A is attached to, from among the faces defining the casing 861A, the face 863A located on the side of the recording medium positioning unit 82 (+Y axis direction). The attachment/detachment unit 30*a* of the second liquid supply apparatus 86B is attached to, from among the faces defining the casing 861B, the face 863B located on the side of the recording medium positioning unit 82 (−Y axis direction).

As shown in FIG. 18 and FIG. 19, the attachment/detachment unit 30*a* including the liquid introduction part 362 and the recording medium container part 821 are arranged next to each other in the horizontal direction. In other words, with respect to the top-to-bottom direction (Z axis direction), at least the liquid introduction part 362 is located within the range where the recording medium container part 821 is located.

As shown in FIG. 20, one end portion of a flow passage member 72*a* of the attachment/detachment unit 30*a* is connected to the flow channel middle part 365 (FIG. 10), and the other end portion is connected to the liquid connection part 122. The other end portion of the flow passage member 72*a* penetrates through the face 863, and is located between the recording medium container part 821 and the casing 861. Also, the other end portion of the flow passage member 72*a* is located in the vicinity of the top end portion of the positioning unit 80 for the recording apparatus in the top-to-bottom direction.

The wires 603 of the attachment/detachment unit 30*a* penetrate through the face 863, and is located between the recording medium container part 821 and the casing 861. Also, the connection connector 604*a* electrically connected to the wires 603 is located in the vicinity of the top end portion of the positioning unit 80 for the recording apparatus in the top-to-bottom direction. The connection connector 604*a* is electrically connected to the electrical connection part 123.

When the positioning unit 80 for the recording apparatus is attached to the main body 19*a*, the flow passage member 72*a* is connected to the liquid connection part 122, and the connection connector 604*a* is connected to the electrical connection part 123. Note that the timing of such connection is not necessarily simultaneous as the time of attaching to the main body 19*a* of the positioning unit 80 for the recording apparatus. For example, the flow passage member 72*a* and the liquid connection part 122, and the connection connector 604*a* and the electrical connection part 123 may be connected after the positioning unit 80 for the recording apparatus is attached to the main body 19*a*.

In this embodiment, inks of the color black (K), yellow (Y), magenta (M), cyan (C), light magenta (LM), and light cyan (LC) are respectively stored in the different liquid containers 50.

The above-described second embodiment achieves the same advantageous effects as the above-described first embodiment, resulting from the same configuration. For example, the positioning unit 80 for the recording apparatus includes the liquid introduction part 362 as the flow channel connection part to which the liquid supply part 57 is connected. Therefore, the liquid container 50 can be attached to or detached from the printer 10 by connecting the liquid supply part 57 to the liquid introduction part 362 or removing the liquid supply part 57 from the liquid introduction part 362.

Also, in the above-described second embodiment, as shown in FIG. 17, the positioning unit 80 for the recording apparatus is located below the main body 19 in the top-to-bottom direction. Thus, it is possible to suppress the increase in size of the printer 10*a* in the horizontal direction. Also, the size in the horizontal direction of the positioning unit 80 for the recording apparatus is substantially the same as the size in the horizontal direction of the main body 19*a*. Thus, even when the positioning unit 80 for the recording apparatus is provided, it is possible to suppress the increase in size of the installation area on which the printer 10*a* is installed.

Also, in the above-described second embodiment, as shown in FIG. 18 and FIG. 19, the liquid introduction part 362 as the flow channel connection part and the recording medium container part 821 are arranged next to each other in the horizontal direction. Thus, it is possible to arrange the liquid introduction part 362 and the recording medium container part 821 while suppressing the increase in size of the printer 10 in the top-to-bottom direction. Usually, the size of the recording medium container part 821 in the horizontal direction is smaller than the size of the main body 19*a* in the horizontal direction. Therefore, when only the recording medium container part 821 is attached to the main body 19*a*, a space (side space) might occur outside the recording medium container part 821 in the horizontal direction in some cases. Since the positioning unit 80 for the recording apparatus has the liquid supply apparatus 86 located outside the recording medium container part 821 in the horizontal direction, the liquid introduction part 362 and the liquid container 50 can be arranged, effectively using the space.

Also, in the above-described second embodiment, as shown in FIG. 19, the recording medium positioning unit 82 as the medium positioning part includes the recording medium container part 821 in which a plurality of pieces of printing paper P can be stored. Therefore, it is unnecessary to set a piece of printing paper P to the printer 10*a* every time recording (printing) to piece of printing paper P is performed.

C. Modified Examples:

Note that the invention is not limited to the above-described implementation examples or embodiments, and may be carried out in various other ways without departing from the spirit of the invention, and the following modifications are also possible.

C-1. First Modified Example:

In the above-described embodiments, the liquid supply apparatus 64, 86 (FIG. 2, FIG. 17) includes the casing 641, 861 for housing the liquid containers 50. However, the casing 641, 861 may be omitted insofar as a wall surface to which the attachment/detachment unit 30, 30*a* can be attached.

C-2. Second Modified Example:

The unit 60 for the recording apparatus according to the above-described first embodiment and the positioning unit 80 for the recording apparatus according to the above-described second embodiment may be combined. In this way, the specifications of the printer 10 may be changed in response to various demands from users.

C-3. Third Modified Example:

The liquid container 50 (FIG. 13) is not limited to the above-described embodiments, and only needs to be provided with a liquid container part for storing a liquid and a liquid supply part for supplying a liquid to the liquid jet recording apparatus. In other words, the liquid container 50 does not necessarily have the handle part 53 or the circuit substrate 582. When the circuit substrate 582 is not provided, the contact mechanism 38 of the attachment/detachment unit 30 may be omitted. Also, although the liquid container part 52 in the above-described embodiments is flexible, it is not necessarily flexible. For example, the liquid container part 52 may be formed from a rigid member (e.g., polyethylene or polypropylene). Also, the liquid container part 52 may be housed in a casing or the like.

C-4. Fourth Modified Example:

In the above-described embodiments, the contact portions cp serving as the container-side electrical connection part are located on the circuit substrate 582 (FIG. 15). However, the invention is not limited to this configuration, and the contact portions cp only need to be provided on the liquid container 50 such that they are electrically contactable with the apparatus-side terminals 381. Also, the contact portions cp may include a contact portion for a terminal used for detecting the attachment/detachment of the liquid container 50. Also, the contact portions cp may be arranged on a circuit substrate that includes a flexible cable, such as a flexible printed circuit (FPC) substrate. This circuit substrate has a contact portion that is contactable with the apparatus-side terminals 381 at one end. The other end is connected to a resetting apparatus, for example. The above-described modified example may be adopted instead of the circuit substrate 582, or adopted together with the circuit substrate 582.

Also, the circuit substrate 582 may be formed by using a bendable (flexible) film. Also, the contact portions cp only need to be arranged so as to be contactable with the apparatus-side terminals 381, and the surface 582*fa* (FIG. 15) on which the contact portions cp are arranged may be a curved surface or have steps.

C-5. Fifth Modified Example:

The invention is not limited to the printers 10 and 10*a*, and is also applicable to a given liquid jet recording apparatus that ejects a liquid other than ink, and to a unit used in the liquid jet recording apparatus. For example, the invention is applicable to the following various types of liquid jet recording apparatuses and units.

(1) Image recording apparatus such as a facsimile apparatus (2) Color material jet recording apparatus used in the manufacture of a color filter for use in an image display device such as a liquid crystal display (3) Electrode material jet recording apparatus used in electrode formation for an organic electroluminescence (EL) display, a field emission display (FED), or the like (4) Liquid jet recording apparatus for ejecting a liquid that contains bioorganic material used in biochip manufacture (5) Specimen jet recording apparatus for use as a precise pipette (6) Lubricating oil jet recording apparatus (7) Resin liquid jet recording apparatus (8) Liquid jet recording apparatus for the pinpoint ejection of lubricating oil in a precision machine such as a clock or camera (9) Liquid jet recording apparatus for ejecting a transparent resin liquid such as an ultraviolet curable resin liquid on a substrate in order to form, for example, microscopic semispherical lenses (optical lenses) for use in an optical communication element or the like

(10) Liquid jet recording apparatus for ejecting an acidic or alkaline etching liquid for etching a substrate or the like

(11) Liquid jet recording apparatus that includes a liquid ejection head for discharging any other microscopic droplets Note that "droplet" refers to the state of a liquid discharged from a liquid jet recording apparatus or a liquid ejection apparatus, and encompasses granular, tear-drop, and trailing string-shaped droplets. Also, the "liquid" referred to here need only be a material that can be ejected from the liquid jet recording apparatus or the liquid ejection apparatus. For example, the "liquid" need only be a material whose substance is in the liquid phase, and the "liquid" here encompasses high or low viscosity liquid materials, as well as liquid materials such as sols, gel water, other inorganic solvents, organic solvents, solutions, liquid resins, and liquid metals (metal melts). Also, the liquid is not limited to being a one-state substance, and the "liquid" here encompasses a substance in which functional material particles made of a solid substance such as pigment or metal particles are dissolved, dispersed, or mixed in a solvent. Other representative examples of liquids include liquid crystal and ink such as that described in the above embodiments. Here, "ink" encompasses general water-based ink and oil-based ink, as well as various types of liquid compositions such as gel ink and hot-melt ink. Also, when UV ink that can be cured by ultraviolet irradiation is stored in the liquid container part connected to the printer, the liquid container bags float above the mounting surface, and the possibility that the heat of the mounting surface is conducted to the liquid container part and cures the UV ink is reduced.

What is claimed is:

1. A unit that is used in a liquid jet recording apparatus and is used for connection of a liquid container, the liquid container including: a liquid container part that is capable of storing a liquid; and a liquid supply part that is in communication with an inside of the liquid container part and is capable of supplying the liquid to an liquid jet part of the liquid jet recording apparatus, the unit comprising:

a medium positioning part that is capable of positioning a recording medium to which the liquid is ejected by the liquid jet part; and a flow channel connection part that is connectable to the liquid supply part and supplies the liquid from the liquid supply part to the liquid jet part, wherein the medium positioning part and the flow channel connection part are integrally formed to be attachable to and detachable together from a main body of the liquid jet recording apparatus, the main body being provided with the liquid jet part.

2. The unit according to claim 1, wherein the unit is located below the main body in a top-to-bottom direction, and the medium positioning part includes a recording medium container part for storing the recording medium.

3. The unit according to claim 2, wherein the flow channel connection part and the recording medium container part are arranged next to each other in a horizontal direction.

4. The unit according to claim 1, wherein the unit is located on a side face of the main body provided with the liquid jet part of the liquid jet recording apparatus, and the flow channel connection part and the medium positioning part are arranged next to each other in a top-to-bottom direction.

5. The unit according to claim 1, wherein the medium positioning part includes a two-sided paper feed part that turns over the recording medium from one side to the other side.

6. A liquid jet recording apparatus, comprising:

the unit according to claim 1; and the liquid jet part that ejects the liquid to the recording medium.

7. A liquid jet recording apparatus comprising: a main body including a liquid jet head; and a liquid supply device for supplying a liquid to the liquid jet head, the liquid supply device comprising:

a liquid container including a liquid container part configured to contain the liquid therein and a liquid supply part configured to supply the liquid toward the liquid jet head from the liquid container part, the liquid container part including a tube, the liquid supply part including a liquid supply port, the tube extending into an interior of the liquid container part toward an opposite side of the liquid supply port; and an attachment/detachment unit that includes a movable member and is detachably attachable to the main body, the liquid container being detachably attachable to the attachment/detachment unit via the movable member, wherein the attachment/detachment unit is located at a position below the position of the liquid jet head, and the attachment/detachment unit includes a liquid introduction part fluidly introducing the liquid from the liquid supply part to a flow passage member of the main body when the attachment/detachment unit is attached to the main body.

8. The liquid jet recording apparatus according to claim 7, wherein the liquid container further includes a contact portion positioning part, in which the contact portion is positioned; and wherein the attachment/detachment unit includes a liquid introduction part and a contact mechanism, the liquid introduction part introducing the liquid from the liquid supply part and the contact mechanism in contact with the electrical contact portion when the liquid container is attached to the attachment/detachment unit.

9. The liquid jet recording apparatus according to claim 7, further comprising a conveyance mechanism configured and arranged to convey a recording medium to the liquid jet head, the attachment/detachment unit located at a position below the position of the conveyance mechanism.

10. The liquid jet recording apparatus according to claim 7, further comprising a two-sided paper feed part configured and arranged to turn over the piece of printing medium.

11. The liquid jet recording apparatus according to claim 7, further comprising a connection unit, through which the attachment/detachment unit is connected with the main body.

12. The liquid jet recording apparatus according to claim 11, wherein the connection unit includes a liquid connection part, whereto the attachment/detachment unit is connected through a flow passage member.

13. The liquid jet recording apparatus according to claim 12, wherein the connection unit includes an electrical connection part;

the liquid container includes a contact portion positioning part; and the electrical connection part is electrically connected to the contact portion positioning part when the liquid container is attached to the attachment/detachment unit electrical connection.

14. The liquid jet recording apparatus according to claim 7, further comprising a medium positioning part that is configured to position a recording medium to which the liquid is ejected by the liquid jet head, the medium positioning part being integrally formed with the attachment/detachment unit.

15. The liquid jet recording apparatus according to claim 7, wherein the tube extends in a direction intersecting with a central axis of the liquid supply port.

16. A liquid jet recording apparatus comprising:

a liquid jet part that ejects a liquid to a medium;

a conveyance mechanism that conveys the medium;

a liquid supply apparatus that supplies the liquid to the liquid jet part; and a medium positioning part that is configured to position the medium to which the liquid is ejected by the liquid jet part, the medium positioning part being integrally formed with the liquid supply apparatus, wherein the liquid supply apparatus includes:

a liquid container that is capable of storing the liquid; and a flow channel connection part that connects the liquid container to a main body of the liquid jet recording apparatus, thereby bringing the liquid container into communication with the liquid jet part, the flow channel connection part is located on a rear side of the main body of the liquid jet recording apparatus, the rear side being an opposite side from a front side of the main body on which an operation panel of the liquid jet recording apparatus is disposed, and when the liquid jet recording apparatus is in a used state, the liquid supply apparatus is disposed to overlap partially with the conveyance mechanism in a height direction of the liquid jet recording apparatus as seen from the rear side.

17. The liquid jet recording apparatus according to claim 16, wherein the liquid container includes a container-side electrical connection part that is capable of connecting to an apparatus-side electrical connection part provided on the main body of the liquid jet recording apparatus.

18. The liquid jet recording apparatus according to claim 16, further comprising a liquid jet head configured to be movable in a direction perpendicular to a direction of conveyance of the medium, wherein the liquid supply apparatus is located on the rear side of a movement area of the liquid jet head.

19. The liquid jet recording apparatus according to claim 16, wherein the liquid container includes a liquid container part configured to contain the liquid therein and a liquid supply part configured to supply the liquid toward the liquid jet part from the liquid container part, the liquid container part includes a tube, the liquid supply part includes a liquid supply port, and the tube extends into an interior of the liquid container part toward an opposite side of the liquid supply port and extends in a direction intersecting with a central axis of the liquid supply port.

* * * * *